US008033345B1

(12) United States Patent
Randall et al.

(10) Patent No.: US 8,033,345 B1
(45) Date of Patent: Oct. 11, 2011

(54) APPARATUS AND METHOD FOR A DRILLING ASSEMBLY

(75) Inventors: Guy Randall, Wooster, OH (US); Brian Hollis, Wadsworth, OH (US); William Burky, Burbank, OH (US); Joe Szarka, West Salem, OH (US); Neil Baker, Gambier, OH (US); Jack Weyer, Wooster, OH (US); Pengfei Yang, Wooster, OH (US); William G. Riel, Wooster, OH (US)

(73) Assignee: Astec Industries, Inc., Chattanooga, TN (US)

( * ) Notice: Subject to any disclaimer, the term of this patent is extended or adjusted under 35 U.S.C. 154(b) by 217 days.

(21) Appl. No.: 12/005,747

(22) Filed: Dec. 28, 2007

Related U.S. Application Data

(63) Continuation-in-part of application No. 11/116,490, filed on Apr. 28, 2005, now Pat. No. 7,318,491.

(60) Provisional application No. 60/567,145, filed on Apr. 30, 2004.

(51) Int. Cl.
*E21B 19/08* (2006.01)
*E21B 44/06* (2006.01)

(52) U.S. Cl. ..... 175/27; 175/162; 175/203; 173/1; 173/44; 173/152

(58) Field of Classification Search ..... 175/27, 175/62, 162, 202, 203; 173/1, 32, 42, 44, 173/28, 152, 185–189
See application file for complete search history.

(56) References Cited

U.S. PATENT DOCUMENTS

| | | | | |
|---|---|---|---|---|
| 2,455,917 | A * | 12/1948 | Crake | 254/267 |
| 3,965,628 | A | 6/1976 | Loftis | |
| 4,605,077 | A * | 8/1986 | Boyadjieff | 175/85 |
| 4,793,421 | A * | 12/1988 | Jasinski | 175/27 |
| 5,713,422 | A * | 2/1998 | Dhindsa | 175/27 |
| 5,794,723 | A | 8/1998 | Caneer et al. | |
| 6,186,248 | B1 * | 2/2001 | Silay et al. | 175/27 |
| 7,100,708 | B2 * | 9/2006 | Koederitz | 175/27 |
| 7,112,018 | B2 * | 9/2006 | Boyl-Davis et al. | 409/178 |
| 7,318,491 | B2 * | 1/2008 | Riel | 175/62 |
| 7,500,530 | B2 * | 3/2009 | Wheeler | 175/26 |
| 2005/0067168 | A1 | 3/2005 | Baird | |
| 2006/0243490 | A1 * | 11/2006 | Riel | 175/62 |
| 2007/0007039 | A1 * | 1/2007 | Noel | 175/40 |
| 2009/0126994 | A1 * | 5/2009 | Tibbitts et al. | 175/27 |

* cited by examiner

*Primary Examiner* — Jennifer H Gay
(74) *Attorney, Agent, or Firm* — Chambliss, Bahner & Stophel, P.C.

(57) ABSTRACT

A drilling assembly for drilling pipe into a drilling surface using a drill bit. The drilling assembly comprises a power unit, a thrust frame, a means for moving the thrust frame, a rotary and carriage assembly and a microprocessor adapted to control the load on the drill based upon the level of mud pressure in the assembly. The drilling assembly is adapted to drill pipe at any angle relative to the drilling surface between substantially parallel to the drilling surface and substantially perpendicular to the drilling surface. The method comprises providing a such drilling assembly, placing a drill pipe onto the drilling assembly, moving the thrust frame to a desired drilling angle, moving the rotary and carriage assembly into direct contact with the drill pipe, applying rotational, thrust and pull-back forces to the drill pipe, drilling the pipe into the drilling surface and controlling the load on the drill bit.

21 Claims, 25 Drawing Sheets

APPARATUS AND METHOD FOR A DRILLING ASSEMBLY

CROSS-REFERENCES TO RELATED APPLICATIONS/PATENTS

This application is a continuation-in-part of U.S. patent application Ser. No. 11/116,490 filed on Apr. 28, 2005 now U.S. Pat. No. 7,318,491 and entitled "Apparatus and Method for Modified Horizontal Directional Drilling Assembly", which claims the benefit of priority from U.S. Provisional Patent Application No. 60/567,145 filed on Apr. 30, 2004 and entitled "Apparatus and Method for Modified Horizontal Directional Drilling Assembly".

FIELD OF THE INVENTION

This invention relates generally to assemblies and methods for subsurface drilling, and particularly to assemblies and methods for horizontal directional and vertical subsurface drilling.

BACKGROUND AND DESCRIPTION OF THE PRIOR ART

It is known to use a vertical drilling rig in oil, gas and coal bed methane well drilling. Conventional vertical drilling rigs use heavy drill pipe or drill collars in order to exert downward force on the drill bit as it enters the earth's surface and begins the well bore. As the drill bit of the conventional vertical drilling rig drills deeper below the earth's surface, it is sometimes necessary to apply force in the opposite direction of the drilling direction (pull-back force) in order to prevent placing too much weight on the drill bit and causing damage to or failure of the drill bit.

It is also known to drill oil, gas and methane wells in a vertical direction initially and then deviate or turn the well bore in increments toward a horizontal direction as the drill bit reaches the target formation. The bore hole is then continued in the horizontal direction for a distance. This method exposes a greater volume of the oil, gas and methane producing formation to the well bore and produces a higher and longer producing well. In order to covert a vertical drilling rig to accomplish the combination vertical-horizontal drilling, it is necessary to retrofit the vertical drilling rig with a top drive adapted to fit into the derrick structure and provide rotational force to the drill pipe, rather than just a rotary table and Kelly bar. Conventionally, a rotary table is fixed to the drill rig floor or base such that it does not move up and down with the drill pipe. A heavy fluted round piece of drill pipe called a Kelly bar slides through the rotary table opening and connects to the drill pipe or casing. The keys that engage with the Kelly bar impart the torque to the drill pipe string and permit the Kelly bar to raise and lower through the rotary table opening. The top drive also provides thrust and pull-back forces which are needed while drilling in the horizontal direction. However, the distances of the horizontal runs produced by conventional devices and methods are limited by the capability of the top drive to apply thrust and pull-back forces to the drill pipe. The diameters of the horizontal runs are also limited by the ability to apply thrust and pull-back forces to the drill pipe.

It is also known to use a variation of the vertical-horizontal drilling method described above which is called slant drilling. In slant drilling, a vertical oil, gas, methane drilling rig is retrofitted such that the derrick is disposed at an angle, e.g., 45° to 60° from horizontal. A top drive applies the rotational, thrust and pull-back forces to the drill pipe. It is further known to use drilling rigs commonly known as super singles for subsurface drilling applications relating to oil, gas and methane. Super single drilling rigs utilize longer Range III drill pipe lengths which are 45 feet in length. Super single drilling rigs, therefore, reduce the number of tool joint connections that are required to be made during a subsurface drilling operation. Consequently, the drilling process can be completed more quickly. Super singles utilize a top drive to rotate the drill pipe, to provide the thrust needed for the drill bit to cut and to control the steering of the cutting assembly. Conventional super singles include top drive units having limited thrust capacity and limited rotary torque capacity. Thus, the horizontal distances and bore hole diameter that may be achieved using a super single are limited.

Still further, conventional drilling rigs include power units that are separate from the drilling apparatus and therefore require multiple truckloads to transport the drill rig. Conventional oil, gas and methane drilling assemblies are not anchored to the ground so as to increase performance specifications. Instead, conventional drilling rigs use their own weight to control the machine performance specifications. As a result, convention drilling machines are very heavy and require multiple truckloads to transport. Conventional oil, gas and methane drilling rigs also use heavy weighted drill collars in the drill pipe string in order to provide the thrust force to the drill pipe and a winch and cable system to provide the pull-back force. Weighted drill collars, however, are not effective in the horizontal direction. Some conventional oil, gas and methane drilling rigs use hydraulic cylinders to provide the trust and pull-back forces. Further, conventional oil, gas and methane machines frequently damage the threaded end of a drill string section when the top drive or rotary table engages the threaded end of the drill string section.

Still further, conventional drilling assemblies do not include a roller drill pipe guide bushing assembly adapted to reduce the wear and damage to the drill pipe string. Conventional drilling assemblies do not include automated drill pipe slips adapted to reduce the amount of time required to perform make-up and break-out operations on the drill pipe and/or casing tool joints. Conventional drilling assemblies do not include pipe handling arms adapted to be pinned to the sub-structure for easy removal during transport. Conventional drilling assemblies do not include a positive rack and pinion carriage (top drive) system which is adapted to provide thrust and pull-back forces to the drill pipe string and eliminate the need for cables, winches, hydraulic cylinders, chain systems and the like to provide such forces. Conventional drilling assemblies also do not include a slip spindle sub assembly which is incorporated into the top drive system and adapted to reduce damage and wear to the drill pipe or casing thread.

It would be desirable therefore, if a drilling assembly could be provided that would produce an increased capacity for drill pipe rotational, thrust and pull-back forces. It would also be desirable if a drilling assembly could be provided that would produce longer well bores and well bores having a greater diameter than those produced by conventional drilling assemblies. It would also be desirable if a drilling assembly could be provided that would be capable of entering the earth and drilling a well bore at an angle steeper than conventional horizontal directional drill assemblies. It would also be desirable if a drilling assembly could be provided that would be capable of entering the earth and drilling a well bore at an angle closer to horizontal than conventional vertical drill assemblies. It would also be desirable if a drilling assembly could be provided that would eliminate the need for heavy drill pipe or drill collars to exert downward force on the drill bit. It would also be desirable if a drilling assembly could be provided that would be more easily transported. It would also be desirable if a drilling assembly could be provided that is adapted to be anchored to the ground so as to increase performance specifications. It would also be desirable if a drilling assembly could be provided that would eliminate the need for cables, winches, hydraulic cylinders, chain systems and the like to provide rotational, thrust and pull-back forces. It would be desirable if a drilling assembly could be provided that would reduce the damage and wear to the threaded end of a drill string section when the top drive or rotary table engages the threaded end of the drill string section. It would be desirable if a drilling assembly could be provided that would reduce the amount of time required to perform make-up and break-out operations on the drill pipe and/or casing tool joints. It would be desirable if a drilling assembly could be provided that includes pipe handling arms adapted to be pinned to the sub-structure for easy removal during transport. It would be desirable if a drilling assembly could be provided that is adapted to perform vertical and horizontal drilling applications with a tube-in-tube drill string. It would also be desirable if a drilling assembly could be provided that would be adapted to continue operations in the event of a power unit failure. It would be further desirable if a drilling assembly could be provided that would be adapted to automatically control the load on the drill bit based upon the level of mud pressure in the drilling assembly. It would be still further desirable if a drilling assembly could be provided that would be adapted to automatically discontinue movement of the rotary and carriage assembly along the thrust frame.

ADVANTAGES OF THE PREFERRED EMBODIMENTS OF THE INVENTION

Among the advantages of the preferred embodiments of the invention is to provide a drilling assembly that produces an increased capacity for drill pipe rotational, thrust and pull-back forces. It is also an advantage of the preferred embodiments of the invention to provide a drilling assembly that is capable of producing longer well bores and well bores having a greater diameter than those produced by conventional drilling assemblies. It another advantage of the preferred embodiments of the invention to provide a drilling assembly that is capable of entering the earth and drilling a well bore at an angle steeper than conventional horizontal directional drill assemblies. It is still another advantage of the preferred embodiments of the invention to provide a drilling assembly that is capable of entering the earth and drilling a well bore at an angle closer to horizontal than conventional vertical drill assemblies. It is yet another advantage of the preferred embodiments of the invention to provide a drilling assembly that eliminates the need for heavy drill pipe or drill collars to exert downward force on the drill bit. It is a further advantage of the preferred embodiments of the invention to provide a drilling assembly that is more easily transported. It is a still further advantage of the preferred embodiments of the invention to provide a drilling assembly that may be anchored to the ground so as to increase performance specifications. It is also an advantage of the preferred embodiments of the invention to provide a drilling assembly that eliminates the need for cables, winches, hydraulic cylinders, chain systems and the like to provide rotational, thrust and pull-back forces. It is also an advantage of the preferred embodiments of the invention to provide a drilling assembly that reduces the damage and wear to the threaded end of a drill string section when the top drive or rotary table engages the threaded end of the drill string section. It another advantage of the preferred embodiments of the invention to provide a drilling assembly that reduces the amount of time required to perform make-up and break-out operations on the drill pipe and/or casing tool joints. It is a further advantage of the preferred embodiments of the invention to provide a drilling assembly that includes pipe handling arms adapted to be pinned to the sub-structure for easy removal during transport. It is a still further advantage of the preferred embodiments of the invention to provide a drilling assembly that is adapted to perform vertical and horizontal drilling applications with a tube-in-tube drill pipe or a tube-in-tube drill pipe string. It is another advantage of the preferred embodiments of the invention to provide a drilling assembly that may be continuously operated in the event of a power unit failure. It is yet another advantage of the preferred embodiments of the invention to provide a drilling assembly that is adapted to automatically control the load on the drill bit based upon the level of mud pressure in the drilling assembly. It is a further advantage of the preferred embodiments of the invention to provide a drilling assembly that is adapted to automatically discontinue movement of the rotary and carriage assembly along the thrust frame.

Additional advantages of the preferred embodiments of the invention will become apparent from an examination of the drawings and the ensuing description.

EXPLANATION OF TECHNICAL TERMS

As used herein, the term "drilling a drill pipe into a drilling surface" includes drilling a bore hole into which a drill pipe or a drill pipe string is pulled. The term "drilling a drill pipe into a drilling surface" also includes pulling the drill pipe or the drill pipe string out of the bore hole.

As used herein, the term "drilling surface" includes the Earth's subsurface strata and any other medium into which a bore hole may be drilled.

As used herein, the term "hydraulic actuator" includes hydraulic cylinders, hydraulic rotary actuators, pneumatic cylinders and any other device or system in which pressurized fluid is used to impart a mechanical force.

As used herein, the term "tube-in-tube" refers to a type of drill pipe or drill pipe string characterized by an outer drill pipe wall and a substantially axially positioned inner drill pipe wall that is substantially surrounded by the outer drill pipe wall.

SUMMARY OF THE INVENTION

The apparatus comprises a drilling assembly for drilling pipe into a drilling surface using a drill bit. The drilling assembly comprises a power unit for supplying power to the assembly, a thrust frame adapted to be moved between a position substantially parallel to the drilling surface and a position substantially perpendicular to the drilling surface and a means for moving the thrust frame. The drilling assembly further comprises a rotary and carriage assembly mounted on the thrust frame. The rotary and carriage assembly is adapted to apply rotational, thrust and pull-back forces to the drill pipe. The drilling assembly also comprises a microprocessor adapted to control the load on the drill bit based upon the level of mud pressure in the drilling assembly. The drilling assembly is adapted to drill pipe into the drilling surface at any angle relative to the drilling surface between substantially parallel to the drilling surface and substantially perpendicular to the drilling surface.

The method for drilling pipe into a drilling surface using a drill bit comprises providing a drilling assembly. The drilling assembly comprises a power unit for supplying power to the assembly, a thrust frame adapted to be moved between a position substantially parallel to the drilling surface and a position substantially perpendicular to the drilling surface, a means for moving the thrust frame, and a rotary and carriage assembly mounted on the thrust frame. The rotary and carriage assembly is adapted to apply rotational, thrust and pull-back forces to the drill pipe. The drilling assembly also comprises a microprocessor adapted to control the load on the drill bit based upon the level of mud pressure in the drilling assembly. The drilling assembly is adapted to drill pipe into the drilling surface at any angle relative to the drilling surface between substantially parallel to the drilling surface and substantially perpendicular to the drilling surface. The method further comprises placing a drill pipe onto the drilling assembly, moving the thrust frame to a desired drilling angle, moving the rotary and carriage assembly into direct contact with the drill pipe, applying rotational, thrust and pull-back forces to the drill pipe, drilling the pipe into the drilling surface and controlling the load on the drill bit based upon the level of mud pressure in the drilling assembly.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
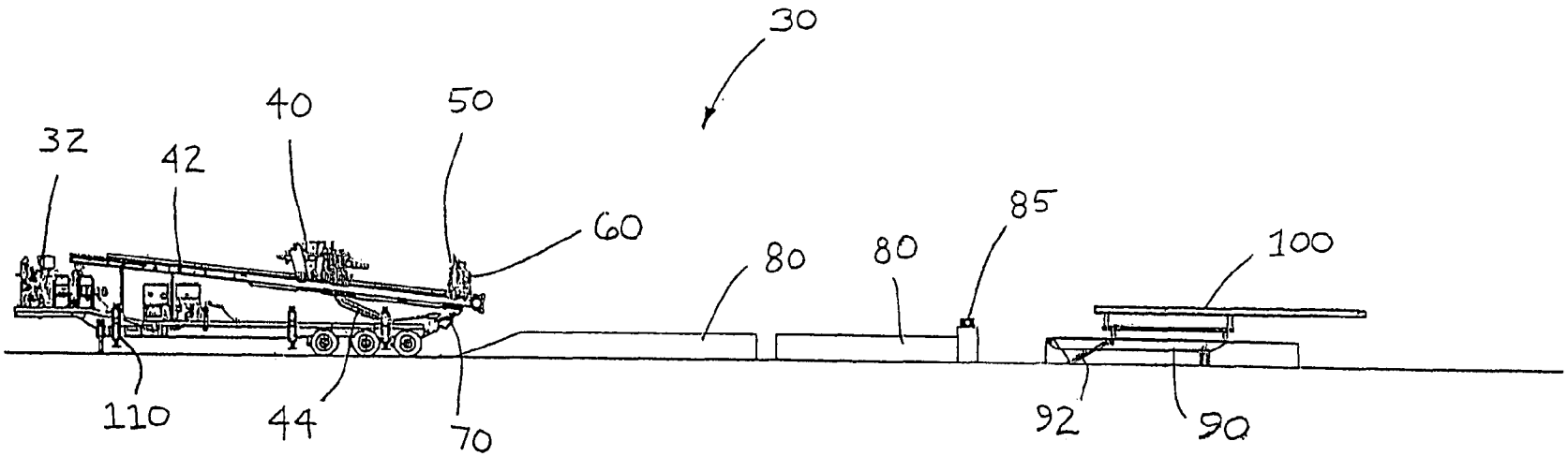
FIG. 1 is a side view of a preferred embodiment of the modified horizontal directional drilling assembly in accordance with the present invention illustrating the drilling assembly in a retracted transport position approaching a drilling site.

Referring now to the drawings, the preferred embodiment of the apparatus and method for the modified horizontal directional drilling assembly of the invention is illustrated in FIGS. 1 through 12. More particularly, as shown in FIGS. 1 through 12, the preferred modified horizontal directional drilling assembly ("modified HDD assembly") is designated generally by reference numeral 30. The preferred modified HDD assembly 30 is adapted for use in both horizontal directional drilling applications and vertical subsurface drilling applications such as oil, gas and methane subsurface drilling.

As shown in FIG. 1, the preferred modified HDD assembly 30 preferably includes a pair of power units 32 and 34 (not shown). The preferred power units are diesel engines, but it is contemplated within the scope of the invention that any suitable power source such as electric motors, diesel engines and generators and the like may be used. A plurality of power units are provided so that drilling operations can continue in the event of the failure of less than all of the power units. More particularly, the preferred HDD assembly 30 comprises two independent power units so that if one of the power units requires repair or maintenance, or if the hydraulic system connected to one of the power units requires repair or maintenance, the assembly can still be operated at full capacity (at half speed) by the other power unit and the drilling operation can continue uninterrupted (run-on-one-technology ("ROOT")). Consequently, the risk of bore hole wall collapse is minimized. The power units are preferably attached to the modified HDD assembly such that they can be transported with the assembly as a single unit. It is contemplated within the scope of the invention, however, that the power units may be removably attached to and transported separate from the other components of the drilling assembly.

Still referring to FIG. 1, the preferred modified HDD assembly 30 also includes rotary and carriage assembly 40. The preferred rotary and carriage assembly 40 is adapted to move along thrust frame 42 and provide thrust force, pull-back force and rotational torque to a drill pipe or casing. The preferred rotary and carriage assembly is a positive rack and pinion carriage system which eliminates the need for cable, winches, hydraulic cylinders, chain systems and the like. The preferred modified HDD assembly further includes breakout wrench assembly 50 and roller-style anti-friction drill pipe guide bushing assembly 60. The preferred breakout wrench assembly 50 is adapted to make-up and break-out the drill pipe tool connections. The preferred bushing assembly 60 is adapted to reduce wear on the drill pipe string.

Figure 3:
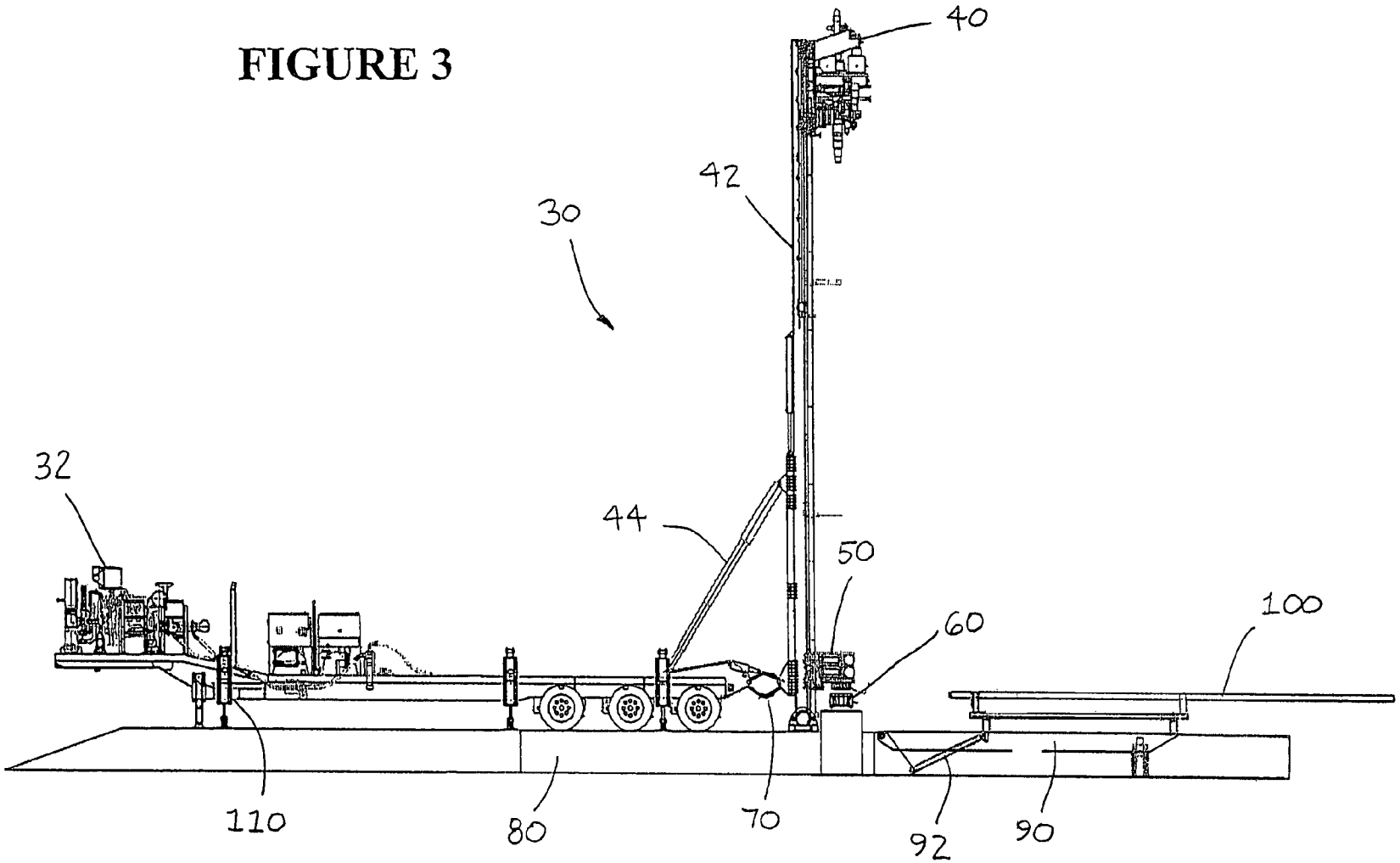
FIG. 3 is a side view of the preferred modified horizontal directional drilling assembly shown in FIGS. 1-2 illustrating the drilling assembly in a vertical subsurface drilling position with the drill pipe in a horizontal stored position.

In addition, the preferred HDD assembly 30 includes a pair of pivoting hinges 70 (see also FIG. 4) which are adapted to permit thrust frame 42 to be pivotally moved between a position approximately parallel to the drilling surface (as shown in FIG. 1) and a position approximately perpendicular to the drilling surface (as shown in FIG. 3). The preferred pivoting hinge 70 is a double hinge arrangement having two pivot points. It is contemplated within the scope of the invention, however, that the pivoting hinge may have less than or more than two pivot points. It is further contemplated within the scope of the invention that less than or more than two pivoting hinges may be used to move thrust frame between a position approximately parallel to the drilling surface and a position approximately perpendicular to the drilling surface.

Figure 4:
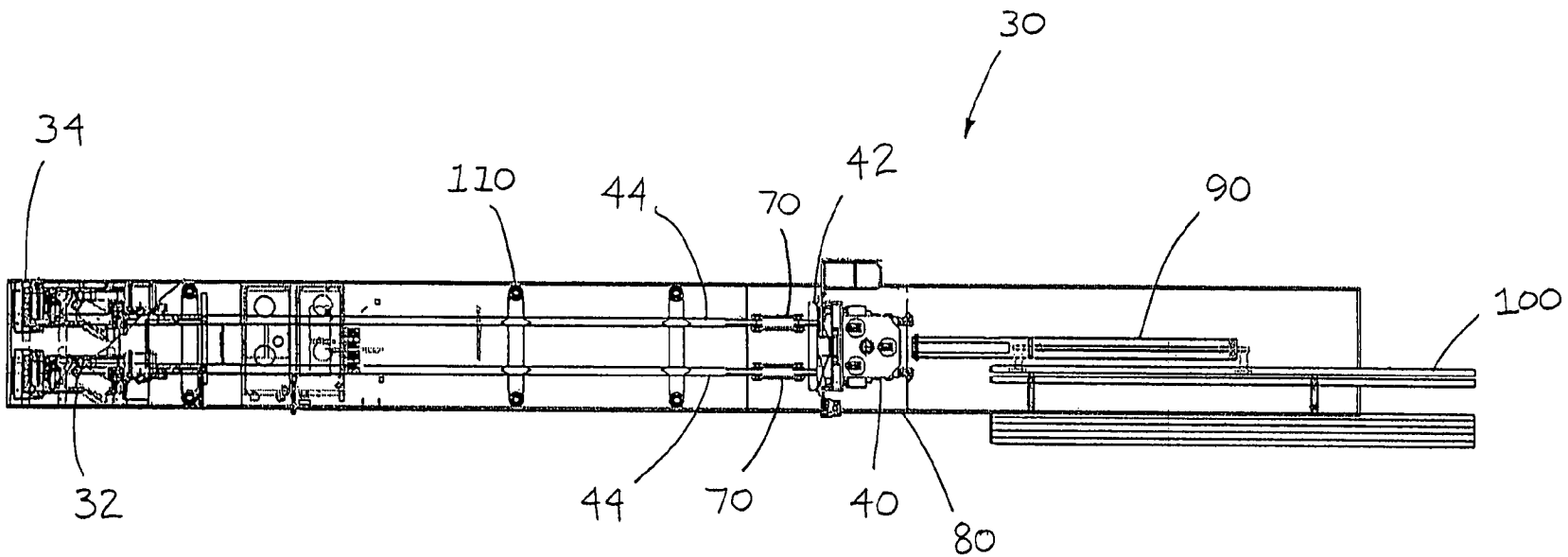
FIG. 4 is a top view of the preferred modified horizontal directional drilling assembly shown in FIG. 3.

Preferably, the rotary and carriage assembly 40 and thrust frame 42 are moved between an approximately horizontal position and an approximately vertical position by frame hydraulic cylinders 44 (see also FIG. 4). It is contemplated within the scope of the invention, however, that any suitable device or assembly may be used to pivotally move the rotary and carriage assembly and the thrust frame between an approximately horizontal position and an approximately vertical position such as a motor and chain assembly, a motor and cable assembly, a motor and gear assembly and the like. It is further contemplated that less than or more than two hydraulic cylinders may be provided to move the rotary and carriage assembly and the thrust frame between an approximately horizontal position and an approximately vertical position. It is still further contemplated that the rotary and carriage assembly and the thrust frame may be moved beyond an approximately vertical position through an approximately 90° arc.

Figure 5:
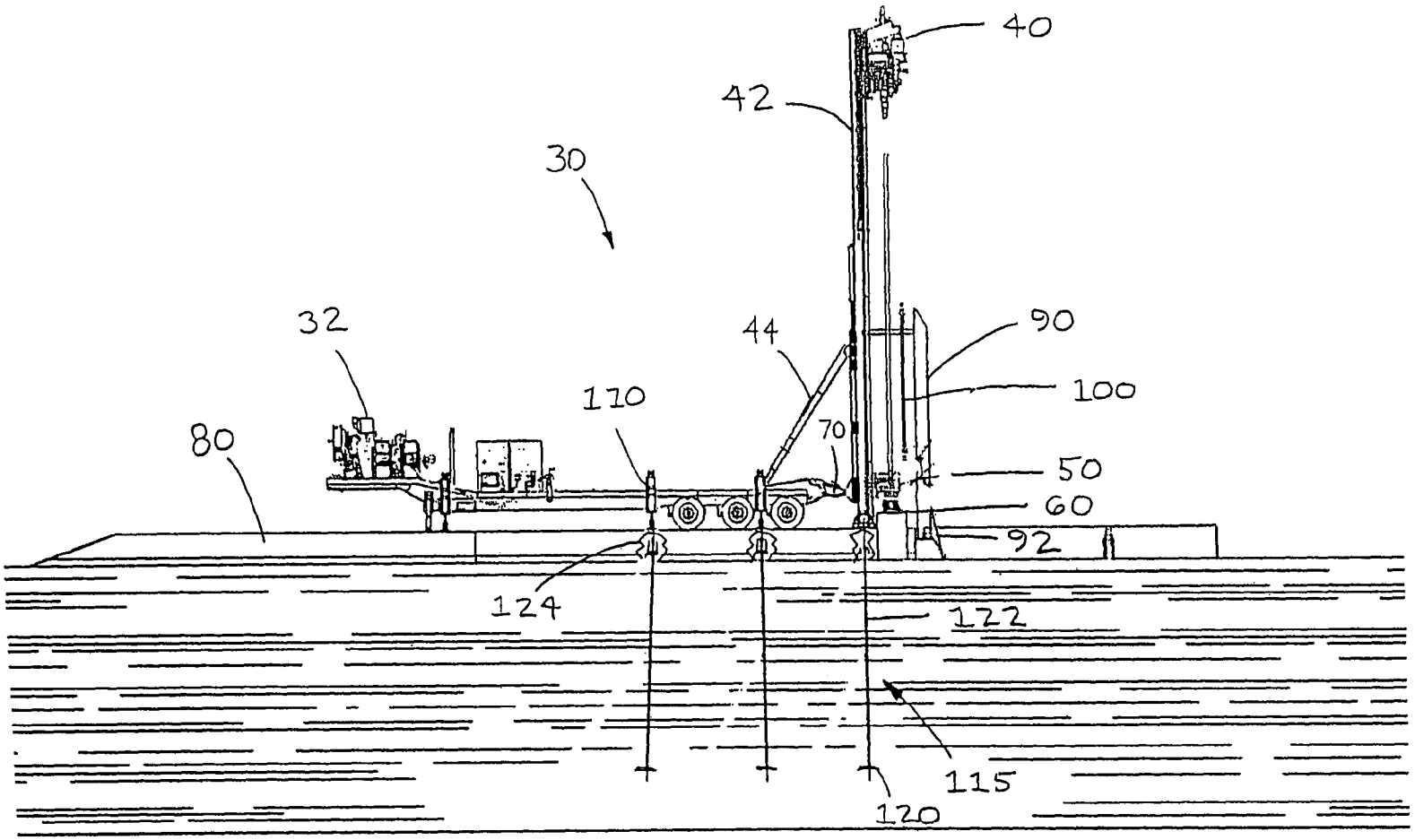
FIG. 5 is a side view of the preferred modified horizontal directional drilling assembly shown in FIGS. 1-4 illustrating the drilling assembly in a vertical subsurface drilling position with the drill pipe in a vertical drilling position and illustrating a preferred anchoring system.

Still referring to FIG. 1, the preferred modified HDD assembly 30 also includes sub-structure 80 which is adapted to raise the assembly to a sufficient height so as to clear a blow-out preventer (BOP). In addition, sub-structure 80 is adapted to anchor the assembly to the ground (as shown in FIG. 5) such that thrust forces in excess of the weight of the assembly and sub-structure may be applied to the drill pipe or casing. The sub-structure illustrated by FIG. 1 is shown in a disassembled condition for transport. The preferred modified HDD assembly 30 further includes remote operated drill pipe or casing slip assembly 85. The preferred slip assembly 85 is adapted to prevent a drill pipe from dropping down into the drill bore. In addition, the preferred slip assembly 85 is adapted to reduce the amount of time required to perform drill pipe and/or casing tool joint make-up and break-out operations. Still further, the preferred slip assembly 85 functions as a safety feature by keeping personnel away from the moving drill pipe and casing.

Figure 7:
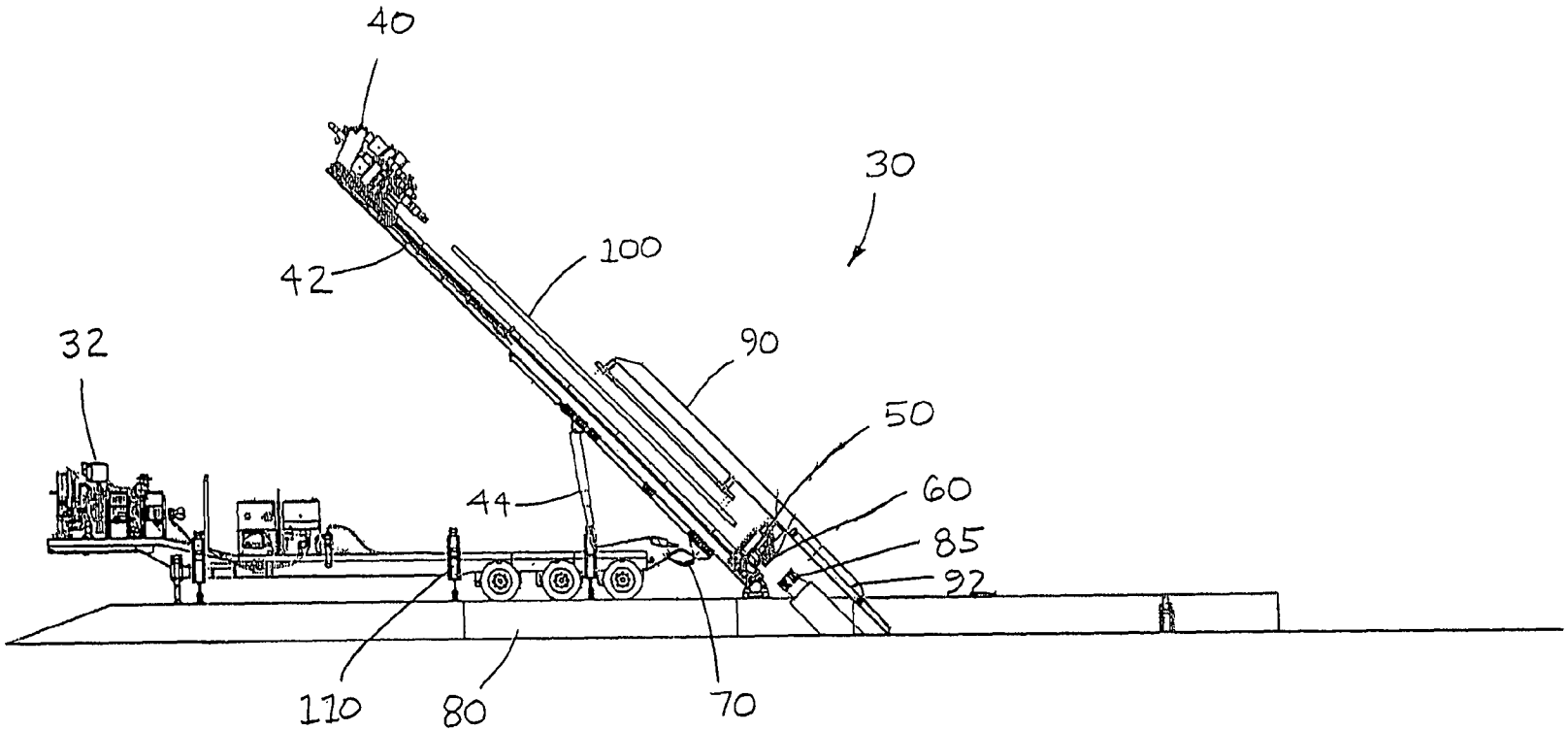
FIG. 7 is a side view of the preferred embodiment of the modified horizontal directional drilling assembly shown in FIGS. 1-6 illustrating the drilling assembly and the drill pipe in a 45° angle slant subsurface drilling position.

Referring still to FIG. 1, drill pipe and casing handler 90 is adapted to pick up drill pipe 100 or casing from an approximately horizontal position substantially parallel to the drilling surface (such as the position in which drill pipes or casings are stored in storage racks). Further, the preferred handler 90 is adapted to pivotally move drill pipe 100 or a casing to an approximately vertical position substantially perpendicular to the drilling surface for vertical subsurface drilling applications. Still further, the preferred handler 90 is adapted to pivotally move drill pipe 100 beyond an approximately vertical position as shown in FIG. 7. In addition, the preferred handler 90 is adapted to hold the drill pipe or casing in position until the rotary and carriage assembly is connected to the drill pipe or casing. The preferred handler 90 is adapted to move the drill pipe or casing into an infinite number of positions from an approximately horizontal stored position to an appropriate position for connection of the drill pipe or casing with the rotary and carriage assembly. The preferred handler 90 is removably connected to sub-structure 80 by one or more pin connections.

Still referring to FIG. 1, handler 90 and drill pipe 100 or a casing are preferably moved from the approximately horizontal stored position to an appropriate position for connection of the drill pipe or casing with the rotary and carriage unit by handler hydraulic cylinder 92. It is contemplated within the scope of the invention, however, that any suitable device or assembly may be used to pivotally move the drill pipe and casing handler between an approximately horizontal stored position and an appropriate position for connection of the drill pipe or casing with the rotary and carriage assembly such as a motor and chain assembly, a motor and cable assembly, a motor and gear assembly, a rotary actuator and the like. It is further contemplated that a plurality of hydraulic cylinders may be provided to move the drill pipe and casing handler between an approximately stored horizontal position and an appropriate position for connection of the drill pipe or casing with the rotary and carriage assembly. The preferred drill pipe 100 is shown in the stored horizontal position. The preferred handler 90 is shown in a condition ready for loading and transport.

Still referring to FIG. 1, the preferred modified HDD assembly 30 further includes a plurality of leveling jacks 110. Leveling jacks 110 are preferably mounted to the assembly and adapted to level the assembly. In addition, the preferred leveling jacks 110 provide stability to modified HDD assembly 30. Further, the preferred leveling jacks 110 are mounted to sub-structure 80 in order to provide additional anchoring forces to the assembly.

Figure 2:
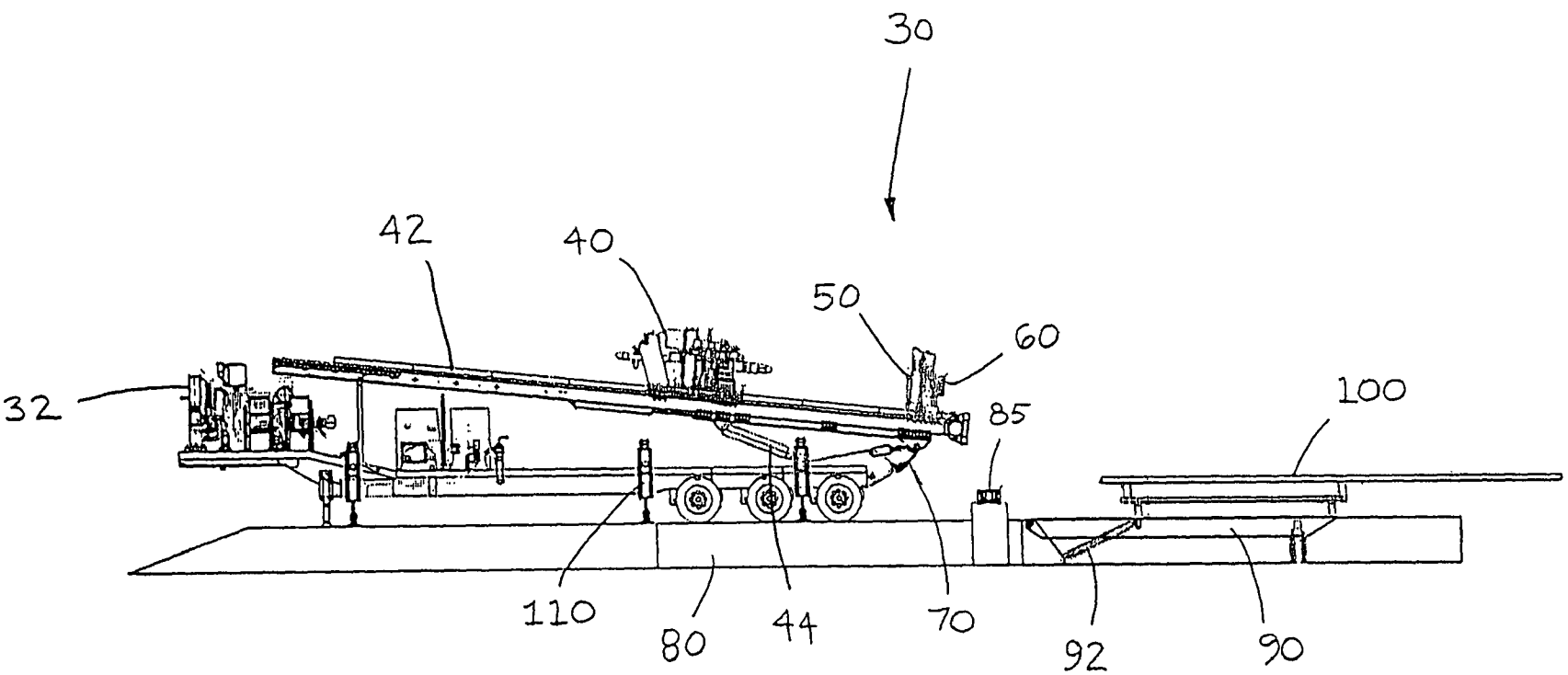
FIG. 2 is a side view of the preferred modified horizontal directional drilling assembly shown in FIG. 1 illustrating the drilling assembly in a retracted transport position on a preferred sub-structure.

Referring now to FIG. 2, a side view of preferred modified HDD assembly 30 is illustrated. More particularly, FIG. 2 illustrates preferred modified HDD assembly 30 in a retracted transport position on preferred sub-structure 80. As shown in FIG. 2, preferred modified HDD assembly 30 includes power unit 32 (power unit 34 not shown), rotary and carriage assembly 40, thrust frame 42, frame hydraulic cylinder 44, breakout wrench assembly 50, bushing assembly 60, pivoting hinge 70, sub-structure 80, slip assembly 85, drill pipe and casing handler 90, handler hydraulic cylinder 92, drill pipe 100 and leveling jacks 110.

Referring now to FIG. 3, a side view of the preferred modified HDD assembly 30 is illustrated. More particularly, FIG. 3 shows the preferred modified HDD assembly 30 in position for a vertical subsurface drilling application. The preferred drill pipe 100 is shown in a horizontal stored position. As shown in FIG. 3, preferred modified HDD assembly 30 includes power unit 32 (power unit 34 not shown), rotary and carriage assembly 40, thrust frame 42, frame hydraulic cylinder 44, breakout wrench assembly 50, bushing assembly 60, pivoting hinge 70, sub-structure 80, slip assembly 85, drill pipe and casing handler 90, handler hydraulic cylinder 92, drill pipe 100 and leveling jacks 110. Further, as shown in FIG. 3, rotary and carriage assembly 40 and thrust frame 42 of preferred modified HDD assembly 30 are adapted to be pivotally rotated from a position approximately parallel to the drilling surface (as shown in FIGS. 1 and 2) to a position approximately perpendicular to the drilling surface in order to perform vertical subsurface drilling applications. Rotary and carriage assembly 40 and thrust frame 42 are preferably moved between an approximately horizontal position and an approximately vertical position by frame hydraulic cylinder 44.

Referring now to FIG. 4, a top view of the preferred modified HDD assembly 30 is illustrated. More particularly, FIG. 4 illustrates preferred modified HDD assembly 30 in the position shown in FIG. 3 with the preferred pivoting hinges 70 in a lowered position. As shown in FIG. 4, modified HDD assembly 30 includes power unit 32, power unit 34, rotary and carriage assembly 40, thrust frame 42, frame hydraulic cylinders 44, pivoting hinges 70, sub-structure 80, drill pipe and casing handler 90, drill pipe 100 and leveling jacks 110.

Referring now to FIG. 5, a side view of the preferred modified HDD assembly 30 is illustrated. More particularly, FIG. 5 illustrates preferred modified HDD assembly 30 in a vertical subsurface drilling application with drill pipe and casing handler 90 and drill pipe 100 in a vertical drilling position. Further, FIG. 5 illustrates the preferred anchoring system 115. As shown in FIG. 5, preferred modified HDD assembly 30 includes power unit 32 (power unit 34 not shown), rotary and carriage assembly 40, thrust frame 42, frame hydraulic cylinder 44, breakout wrench assembly 50, bushing assembly 60, pivoting hinge 70, sub-structure 80, slip assembly 85, drill pipe and casing handler 90, handler hydraulic cylinder 92, drill pipe 100, leveling jacks 110 and tipping plate anchors 120. Further, as shown in FIG. 5, drill pipe and casing handler 90 is adapted to releasable retain and pivotally move drill pipe 100 from a position approximately parallel to the drilling surface (as shown in FIGS. 1-3) to a position approximately perpendicular to the drilling surface. Preferably, drill pipe and casing handler 90 is moved between a position approximately parallel to the drilling surface and a position approximately perpendicular to the drilling surface by handler hydraulic cylinder 92.

Still referring to FIG. 5, the preferred anchoring system 115 includes tipping plate anchors 120 which are adapted to be driven into the ground to the required depth. Anchor rod 122 extends from the tipping plate anchors 120 to the ground surface. Anchor rod 122 may be connected to sub-structure 80 by anchor hydraulic cylinder 124. The preferred anchor hydraulic cylinder 124 is adapted to be set into a socket into the frame of sub-structure 80 such that the cylinder may be pivoted for alignment with the anchor rod. The preferred anchor hydraulic cylinder is also adapted to tip the tipping plate anchor and maintain a pre-determined hydraulic pressure such that the desired anchor rod tensional load will be maintained during drilling operations. In the alternative, anchor rod 122 may be connected to sub-structure 80 using a split tapered bushing which is adapted to lock onto the anchor rod and be inserted into a tapered housing connected to the sub-structure. As the anchor loads are increased, the split tapered bushing fits more tightly in the tapered housing, thereby increasing the anchor rod grip force.

Figure 6:
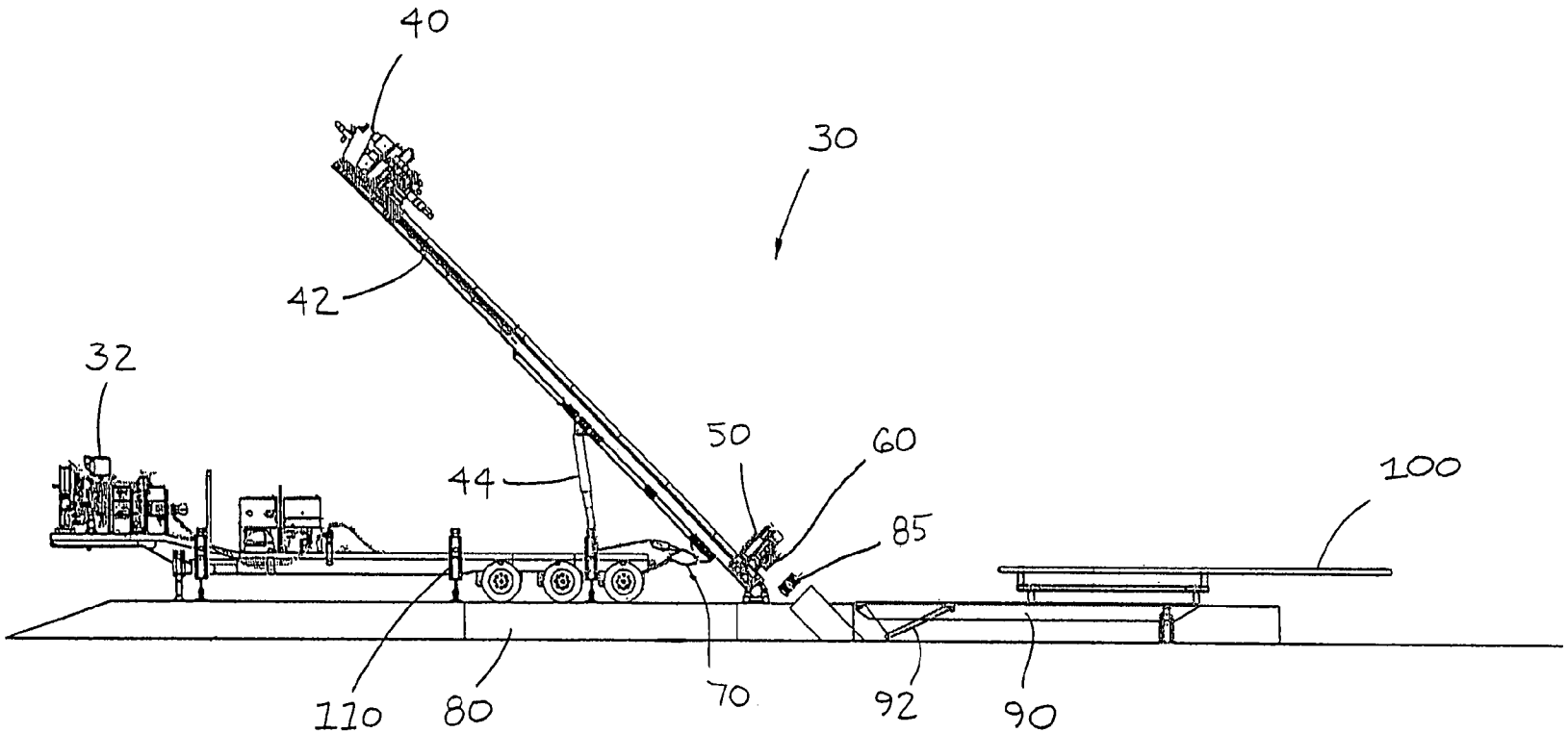
FIG. 6 is a side view of the preferred embodiment of the modified horizontal directional drilling assembly shown in FIGS. 1-5 illustrating the drilling assembly in a 45° angle slant subsurface drilling position with the drill pipe in a horizontal stored position.

Referring now to FIG. 6, a side view of the preferred modified HDD assembly 30 is illustrated. More particularly, FIG. 6 illustrates rotary and carriage assembly 40, thrust frame 42, drill pipe and casing breakout wrench assembly 50, drill pipe guide bushing assembly 60 and slip assembly 85 of preferred modified HDD assembly 30 in a 45° angle slant subsurface drilling position with drill pipe 100 in a horizontal stored position. The preferred pivoting hinge 70 is shown in a lowered position. As shown in FIG. 6, modified HDD assembly 30 includes power unit 32 (power unit 34 not shown), rotary and carriage assembly 40, thrust frame 42, frame hydraulic cylinder 44, breakout wrench assembly 50, bushing assembly 60, pivoting hinge 70, sub-structure 80, slip assembly 85, drill pipe and casing handler 90, handler hydraulic cylinder 92, drill pipe 100 and leveling jacks 110. Further, as shown in FIG. 6, rotary and carriage assembly 40 and thrust frame 42 of preferred modified HDD assembly 30 are adapted to be pivotally rotated from a position approximately parallel to the drilling surface (as shown in FIGS. 1 and 2) to a position approximately 45° from the horizontal drilling surface in order to perform slant subsurface drilling applications. Rotary and carriage assembly 40 and thrust frame 42 are preferably moved between an approximately horizontal position and a position approximately 45° from the horizontal drilling surface by frame hydraulic cylinder 44.

Referring now to FIG. 7, a side view of the preferred modified HDD assembly 30 is illustrated. More particularly, FIG. 7 illustrates preferred modified HDD assembly 30, rotary and carriage assembly 40, breakout wrench assembly 50, guide bushing assembly 60, slip assembly 85 and preferred drill pipe 100 in a 45° angle slant subsurface drilling position. The preferred pivoting hinge 70 is shown in a lowered position. As shown in FIG. 6, modified HDD assembly 30 includes power unit 32 (power unit 34 not shown), rotary and carriage assembly 40, thrust frame 42, frame hydraulic cylinder 44, breakout wrench assembly 50, bushing assembly 60, pivoting hinge 70, sub-structure 80, slip assembly 85, drill pipe and casing handler 90, handler hydraulic cylinder 92, drill pipe 100 and leveling jacks 110. Further, as shown in FIG. 6, drill pipe and casing handler 90 and drill pipe 100 are adapted to be pivotally rotated from a position approximately parallel to the drilling surface (as shown in FIGS. 1, 2, 3 and 6) to a position approximately 45° from the horizontal drilling surface in order to perform slant subsurface drilling applications. Drill pipe and casing handler 90 and drill pipe 100 are preferably moved between an approximately horizontal position and a position approximately 135° from the horizontal drilling surface by handler hydraulic cylinder 92.

Figure 8:
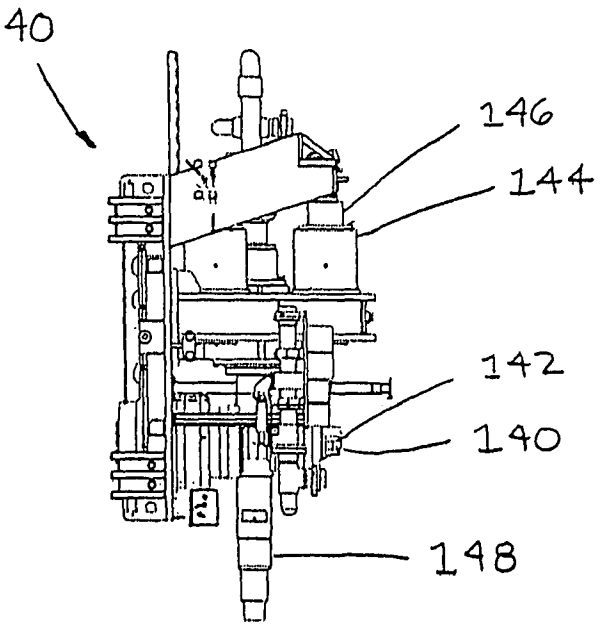
FIG. 8 is a side view of the rotary and carriage assembly of the preferred embodiment of the modified horizontal directional drilling assembly shown in FIGS. 1-7.

Referring now to FIG. 8, a side view of rotary and carriage assembly 40 of the preferred embodiment of modified HDD assembly 30 is illustrated. The preferred rotary and carriage assembly 40 is adapted to apply thrust and pull-back forces to a drill pipe or casing or a string of drill pipes or casings through a combination of pinion drive planetary gearboxes and hydraulic motors. More particularly, as shown in FIG. 8, preferred rotary and carriage assembly 40 includes carriage drive planetary gearboxes 140 and carriage drive motors 142.

The preferred rotary and carriage assembly further includes rotary gearbox planetary gearboxes 144, rotary gearbox hydraulic motors 146 and rotary gearbox output spindle 148. The preferred rotary gearbox and the preferred output spindle applies rotational torque to a drill pipe or a string of drill pipes. While FIG. 8 illustrates hydraulic motors adapted to provide a power source to the preferred rotary and carriage assembly, it is contemplated within the scope of the invention that the rotary and carriage assembly may be powered by and suitable power source such as an electric motor and the like.

Figure 9:
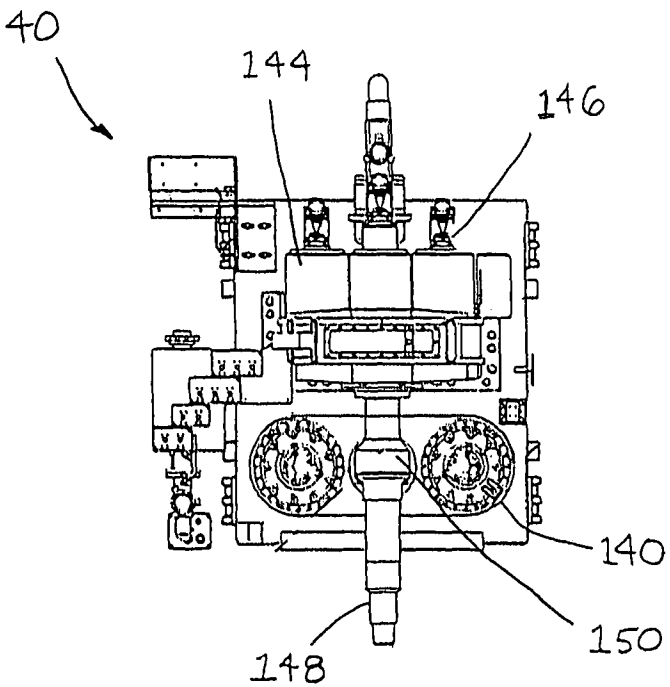
FIG. 9 is a top view of the preferred rotary and carriage assembly shown in FIGS. 1-8.

Referring now to FIG. 9, a top view of preferred rotary and carriage assembly 40 is illustrated. As shown in FIG. 9, preferred rotary and carriage assembly 40 includes carriage drive planetary gearboxes 140 and carriage drive motors 142. The preferred rotary and carriage assembly further includes rotary gearbox planetary gearboxes 144, rotary gearbox hydraulic motors 146 and rotary gearbox output spindle 148. In addition, preferred rotary and carriage assembly 40 includes telescoping slip spindle sub assembly 150 which is described in more detail below.

Figure 10:
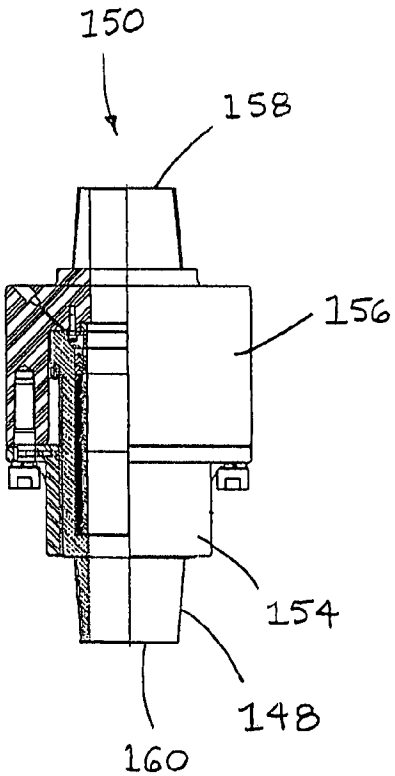
FIG. 10 is a partial sectional side view of the telescoping slip spindle sub assembly of the preferred embodiment of the modified horizontal directional drilling assembly shown in FIGS. 1-9 illustrating the slip spindle sub assembly output spindle in a retracted condition.

Referring now to FIG. 10, a partial sectional side view of the preferred telescoping slip spindle sub assembly 150 of the preferred embodiment of modified HDD assembly 30 is illustrated. More particularly, FIG. 10 illustrates preferred slip spindle sub assembly 150 with output spindle 148 in a retracted condition. As shown in FIG. 10, preferred slip spindle sub assembly 150 includes output spindle 148, drive sleeve 154 and housing 156. The preferred output spindle 148 is adapted to extend and retract in a telescoping manner depending upon the direction of the thrust loading applied to the rotary and carriage assembly. Preferably, the output spindle axially extends from and axially retracts into housing 156 a distance of approximately four inches. The preferred drive sleeve 154 engages preferred output spindle 148 so as to transmit rotational torque from slip spindle input end 158 to slip spindle output end 160. The preferred slip spindle sub assembly reduces damage and wear to the drill pipe and casing thread extends the life of drill pipe tool joint connections threads as a result of the telescoping action of output spindle 148.

Figure 11:
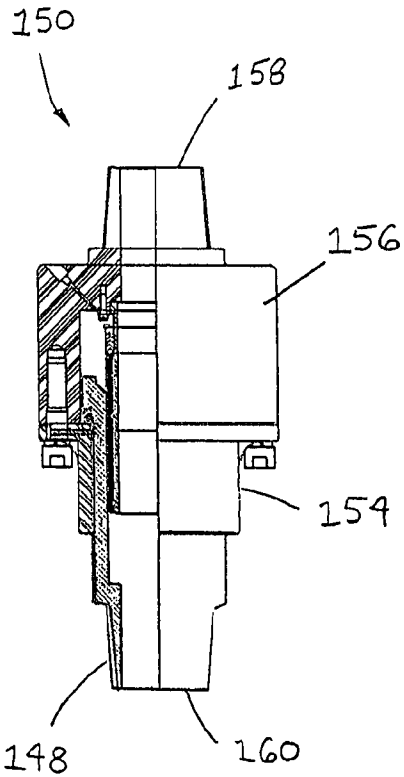
FIG. 11 is a partial sectional side view of the telescoping slip spindle sub assembly of the preferred embodiment of the modified horizontal directional drilling assembly shown in FIGS. 1-10 illustrating the slip spindle sub assembly output spindle in an extended condition.

Referring now to FIG. 11, a partial sectional side view of the preferred telescoping slip spindle sub assembly 150 of the preferred embodiment of modified HDD assembly 30 is illustrated. More particularly, FIG. 11 illustrates preferred slip spindle sub assembly 150 with output spindle 148 in an extended condition. As shown in FIG. 11, preferred slip spindle sub assembly 150 includes output spindle 148, drive sleeve 154, housing 156, input end 158 and output end 160.

Figure 12:
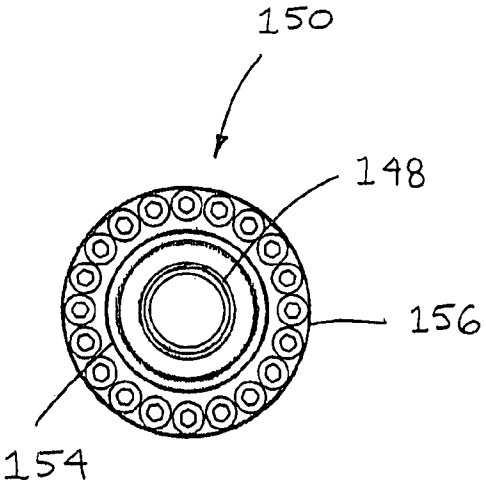
FIG. 12 is an end view of the telescoping slip spindle sub assembly of the preferred embodiment of the modified horizontal directional drilling assembly shown in FIGS. 1-11.

Referring now to FIG. 12, a cross-sectional view of the preferred telescoping slip spindle sub assembly 150 of the preferred embodiment of modified HDD assembly 30 is illustrated. More particularly, as shown in FIG. 12, preferred slip spindle sub assembly 150 includes output spindle 148, drive sleeve 154 and housing 156.

Figure 13:
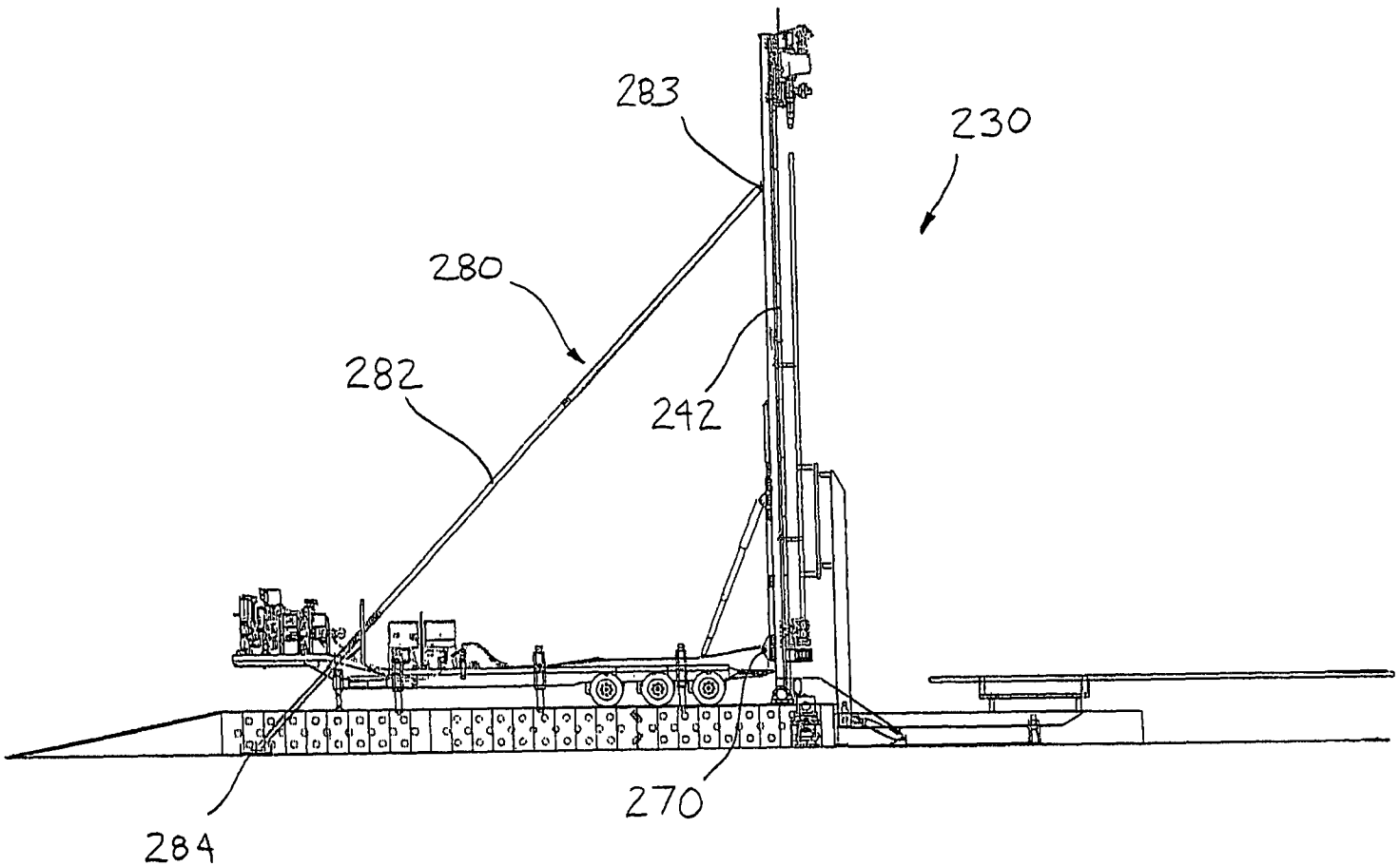
FIG. 13 is a side view of a first alternative embodiment of the modified horizontal directional drilling assembly of the present invention illustrating the fixed pivot and the wide strut system.

Referring now to FIG. 13, a side view of a first alternative embodiment of the modified horizontal directional drilling assembly is illustrated. More particularly, the preferred modified horizontal directional drilling assembly 230 includes fixed pivot 270 and wide strut system 280. The preferred fixed pivot 270 is adapted to permit thrust frame 242 to be pivotally moved between a position that is substantially parallel to the drilling surface and a position that is substantially perpendicular to the drilling surface. Preferably, fixed pivot 270 is adapted to permit thrust frame 242 to be moved through an approximately 90° angle.

Figure 14:
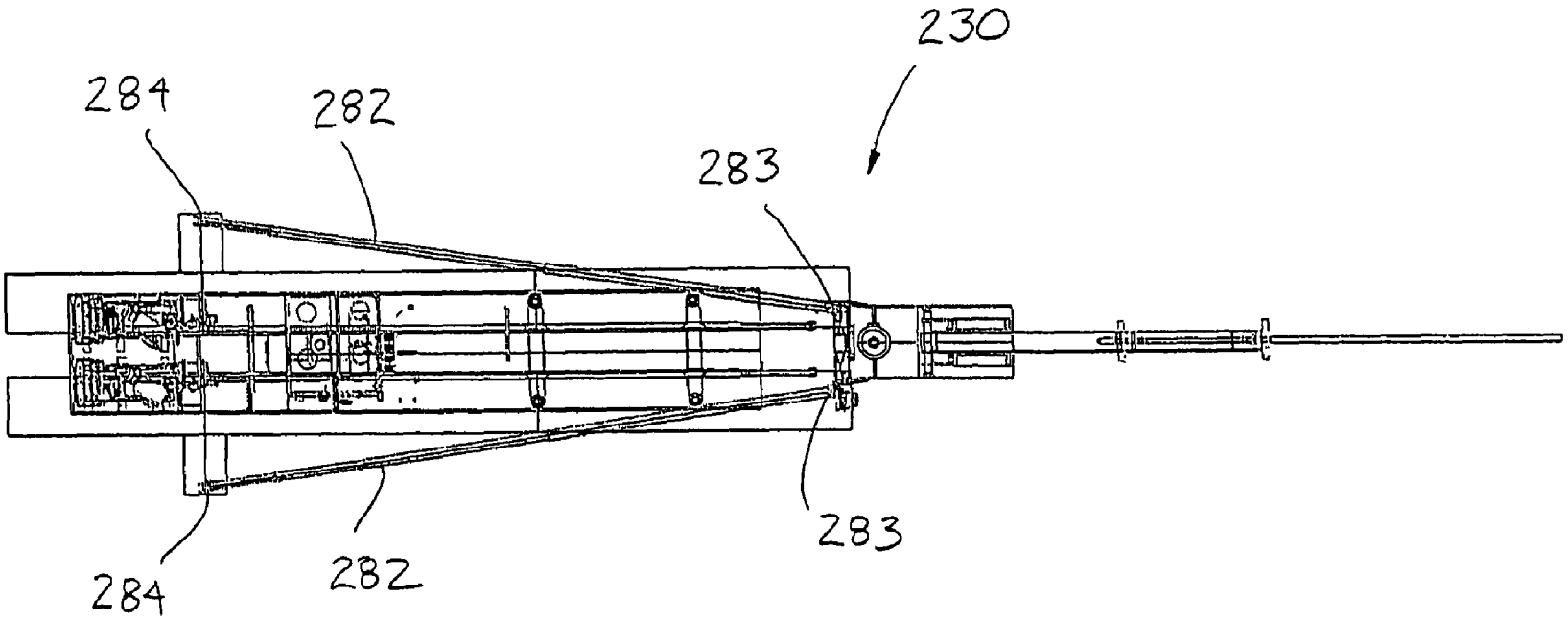
FIG. 14 is a top view of the first alternative embodiment of the modified horizontal directional drilling assembly illustrated in FIG. 13.

Referring now to FIGS. 13 and 14, the preferred wide strut system 280 is adapted to provide stability to the drilling assembly. The preferred wide strut system includes a pair of wide strut system arms 282, each of which have a thrust frame end 283 attached to thrust frame 242 and an anchoring end 284 adapted to be anchored to sub-structure 280. While the wide strut system illustrated in FIGS. 13 and 14 includes a pair of arms, it is contemplated within the scope of the invention that the wide strut system may include more or less than two arms. It is also contemplated within the scope of the invention that the anchoring end of the arms may be anchored to any suitable support structure, including but not limited to, the drilling surface. Further, although the wide strut system illustrated in FIGS. 13 and 14 shows the thrust frame in a substantially vertical position, it is contemplated within the scope of the invention that the wide strut system may be adapted for use when the thrust frame is not in a substantially vertical position.

Figure 15:
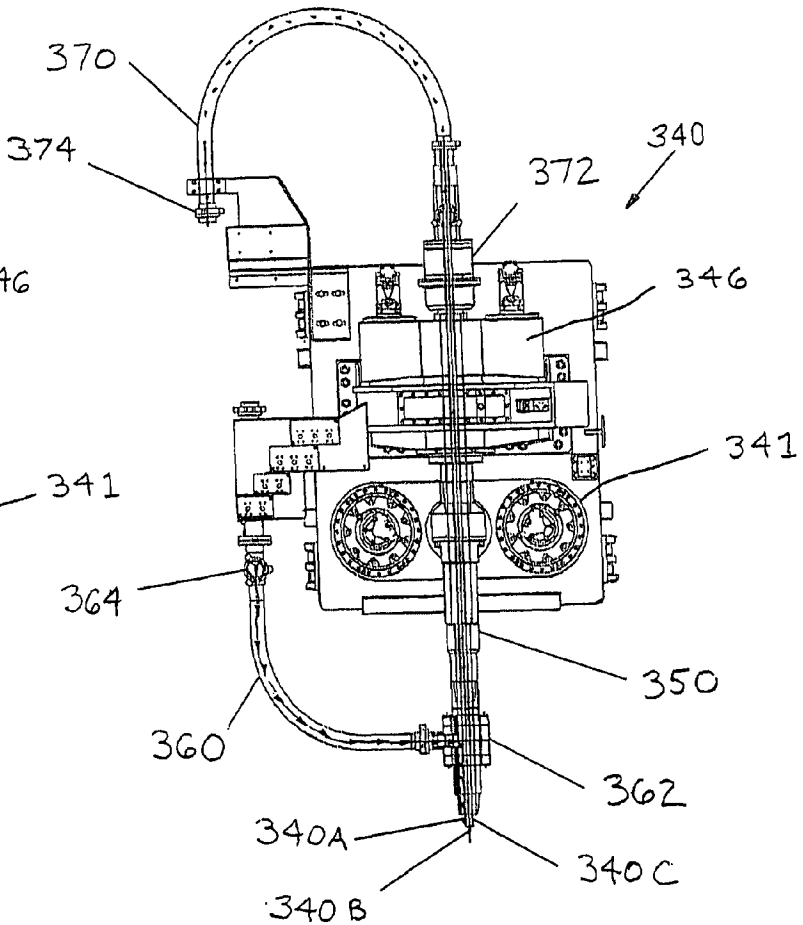
FIG. 15 is a top view of an alternative embodiment of the rotary and carriage assembly of the preferred modified horizontal directional drilling assembly of the present invention.
Figure 15A:
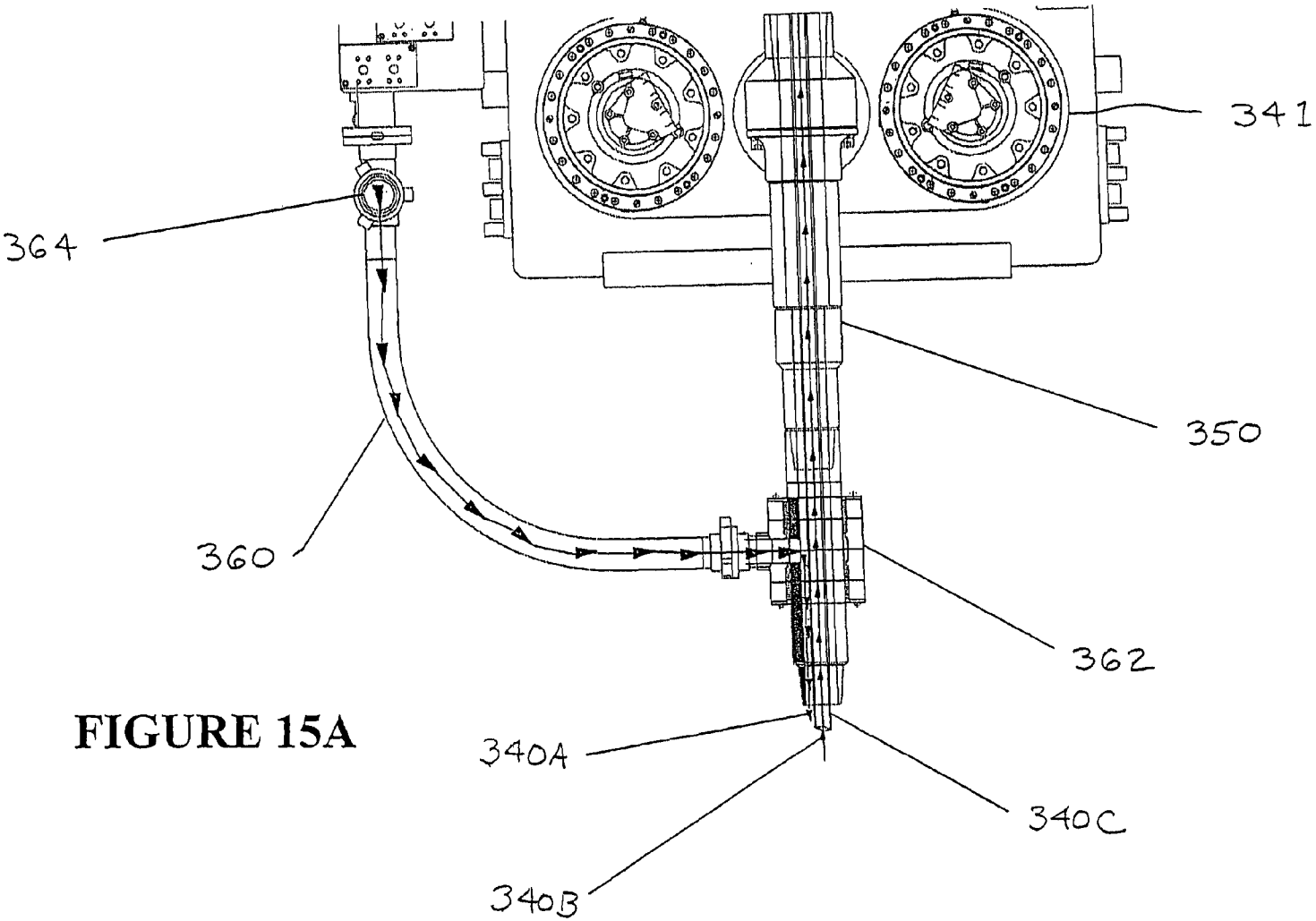
FIG. 15A is an enlarged view of the lower portion of the preferred rotary and carriage assembly illustrated in FIG. 15.

Referring now to FIG. 15, a top view of an alternative embodiment of the rotary and carriage assembly of the preferred modified horizontal directional drilling assembly of the present invention is illustrated. The preferred rotary and carriage assembly is designated generally by reference numeral 340. The preferred rotary and carriage assembly 340 is adapted to for use in connection with tube-in-tube drill pipes and tube-in-tube drill pipe strings. More particularly, the preferred rotary and carriage assembly 340 is adapted to pump fluid (such as bentonite, air, water and the like) through the annular channel located between the inner tube and the outer tube of a tube-in-tube drill pipe toward the cutting tool (such as a percussion hammer) of the drill pipe string. In such a tube-in-tube drill pipe application, the fluid pumped through the annular channel of the drill pipe actuates the cutting tool, removes cuttings from the face of the cutting tool, and directs the cuttings into the inner tube for discharge to the drilling surface. FIG. 15A illustrates in detail the flow of fluid and cuttings (represented by arrowed lines 340A and 340B, respectively) through the lower portion of the rotary and carriage assembly. FIG. 15A also clearly illustrates the preferred center cuttings discharge hose 340C which is adapted to convey cuttings from the inner tube of a tube-in-tube drill pipe (or tube-in-tube drill pipe string) to the cuttings discharge tube 370, which is described below.

Figure 16:
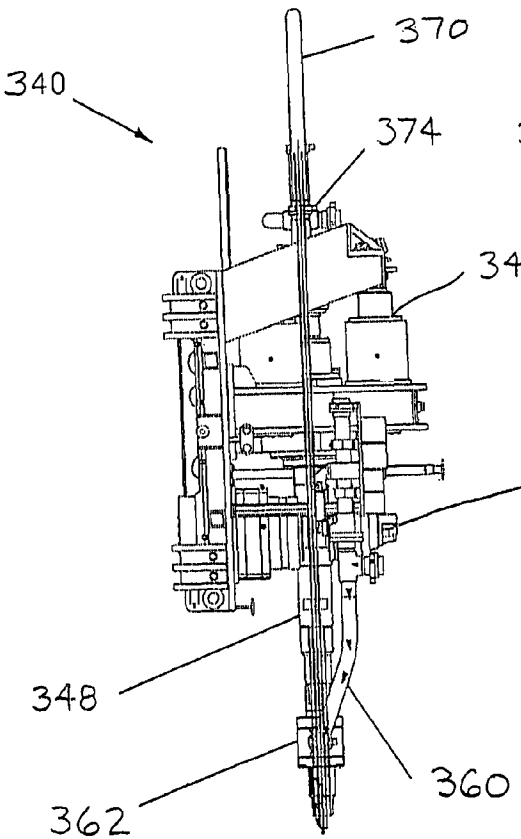
FIG. 16 is a side view of the alternative embodiment of the rotary and carriage assembly illustrated in FIGS. 15 and 15A.

As shown in FIGS. 15 and 16, the preferred rotary and carriage assembly 340 includes carriage drive planetary gearbox 341, rotary gearbox hydraulic motor 346, rotary gearbox output spindle 348 and telescoping slip spindle sub assembly 350. In addition, the preferred rotary and carriage assembly 340 includes plumbing adapted to convey fluid to the annular channel between the inner tube and the outer tube of a tube-in-tube drill pipe and/or a tube-in-tube drill pipe string. The preferred rotary and carriage assembly 340 includes plumbing adapted to convey cuttings from the inner tube of the tube-in-tube drill pipe out of the drilling assembly. More particularly, in the preferred rotary and carriage assembly, fluid inlet tube 360 is connected to below rotary side inlet swivel 362 such that fluid in conveyed to the annular channel between the inner tube and the outer tube of a tube-in-tube drill pipe. Preferably, an inlet hammer union 364 or some other suitable connection device is located at the upstream end of the fluid inlet tube. Also in the preferred rotary and carriage assembly, cuttings discharge tube 370 is connected to above rotary swivel 372 such that cuttings from the inner tube of the tube-in-tube drill pipe may be conveyed out of the assembly. The preferred discharge tube 370 also includes discharge hammer union 374 or some other suitable connecting device. While the preferred fluid inlet tube 360 and the preferred cuttings discharge tube 370 are illustrated in their preferred configuration and arrangement, it is contemplated within the scope of the invention that the tubes may be any suitable configuration and they may be located in any suitable arrangement.

In operation, several advantages of the apparatus and method of the preferred embodiments of the invention are realized. For example, the preferred embodiments of the drilling assembly produce an increased capacity for drill pipe rotational, thrust and pull-back forces. The preferred embodiments of the drilling assembly are capable of producing longer well bores and well bores having a greater diameter than those produced by conventional drilling assemblies. The preferred embodiments of the drilling assembly are capable of entering the earth and drilling a well bore at any angle between approximately parallel to a horizontal drilling surface to a 90° vertical angle. Consequently, the preferred embodiments of the drilling assembly are capable of drilling at an angle steeper than conventional horizontal directional drill assemblies and at an angle closer to horizontal than conventional vertical drill assemblies. The anchoring system and rotary and carriage assembly of the preferred embodiments of the drilling assembly eliminate the need for heavy drill pipe or drill collars in order to exert downward force on the drill bit. The preferred embodiments of the drilling assembly are more easily transported than conventional drilling assemblies as a result of on-board power units and the reduced weight of the assembly. The rack and pinion rotary and carriage assembly of the preferred embodiments of the drilling assembly eliminates the need for cables, winches, hydraulic cylinders, chain systems and the like to provide rotational, thrust and pull-back forces. The slip assembly of the preferred embodiments of the drilling assembly also reduces damage and wear to the threaded end of a drill string section when the top drive or rotary table engages the threaded end of the drill string section. The preferred embodiments of the drilling assembly further reduce the amount of time required to perform make-up and break-out operations on the drill pipe and/or casing tool joints. The arms of the pipe and casing handler of the preferred embodiments of the drilling assembly, which are pinned to the sub-structure, allow for easy removal during transport. The preferred embodiments of the drilling assembly are also adapted to perform vertical and horizontal directional drilling applications with a tube-in-tube drill pipe and a tube-in-tube drill pip string. In addition, in the event of a power unit failure, the preferred embodiments of the drilling assembly may continue to be operated as a result of the plurality of power units provided (run-on-one-technology).

Figure 17:
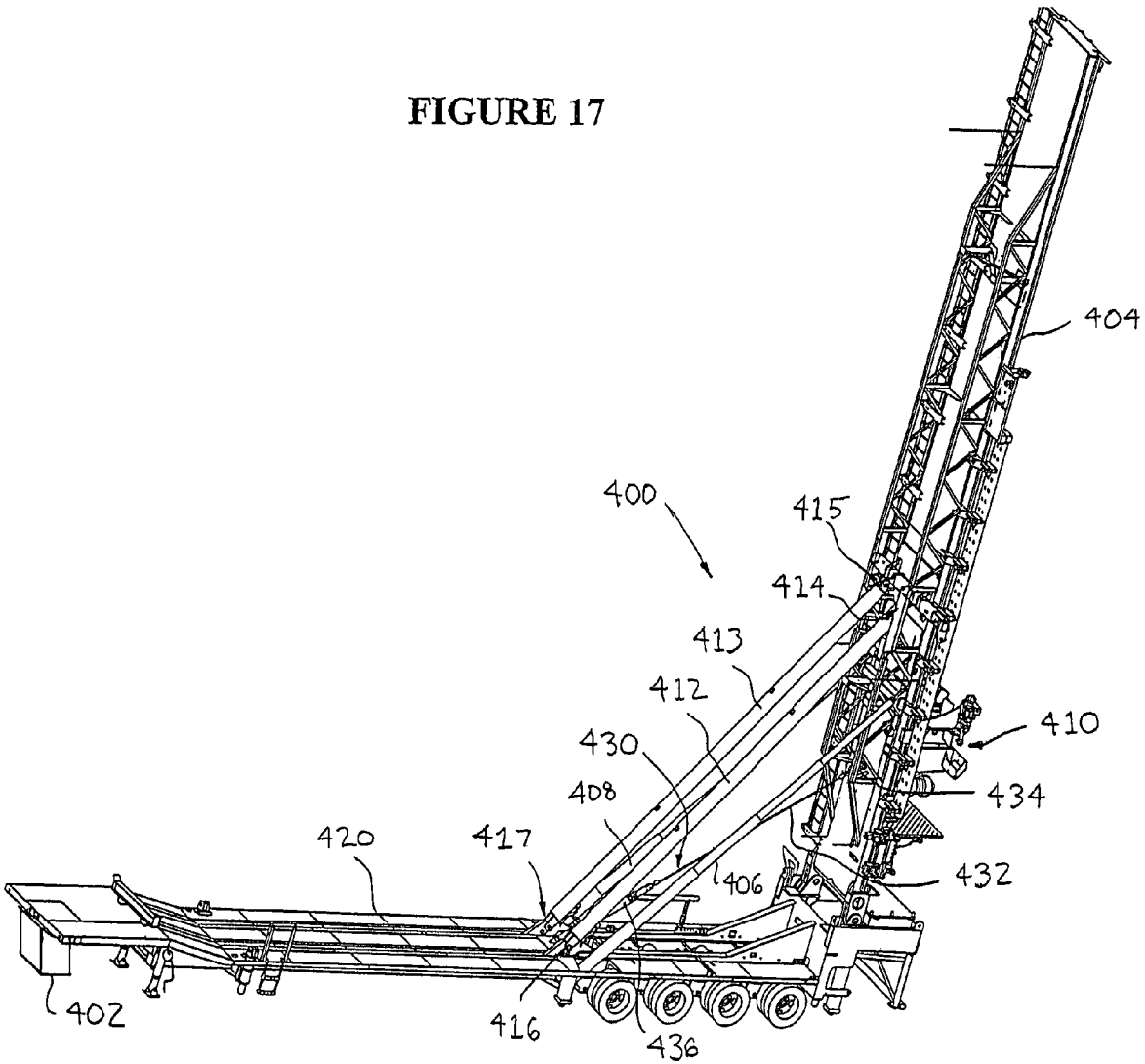
FIG. 17 is a perspective view of a second alternative embodiment of the drilling assembly in accordance with the present invention.

Referring now to FIG. 17, a perspective view of a second alternative embodiment of the drilling assembly in accordance with the present invention is illustrated. As shown in FIG. 17, the second alternative embodiment of the drilling assembly in accordance with the present invention is designated generally by reference numeral 400. The preferred drilling assembly 400 is adapted to drill pipe into a drilling surface using a drill bit. The preferred drilling assembly 400 includes power unit 402 for supplying power to the drilling assembly and thrust frame 404. The preferred thrust frame 404 is adapted to be moved between a position substantially parallel to the drilling surface and a position substantially perpendicular to the drilling surface. The preferred drilling assembly 400 also includes a means for moving the thrust frame such as telescoping cylinders 406 and 408. The preferred drilling assembly 400 is adapted to drill pipe into the drilling surface at any angle relative to the drilling surface between substantially parallel to the drilling surface and substantially perpendicular to the drilling surface.

Figure 18:
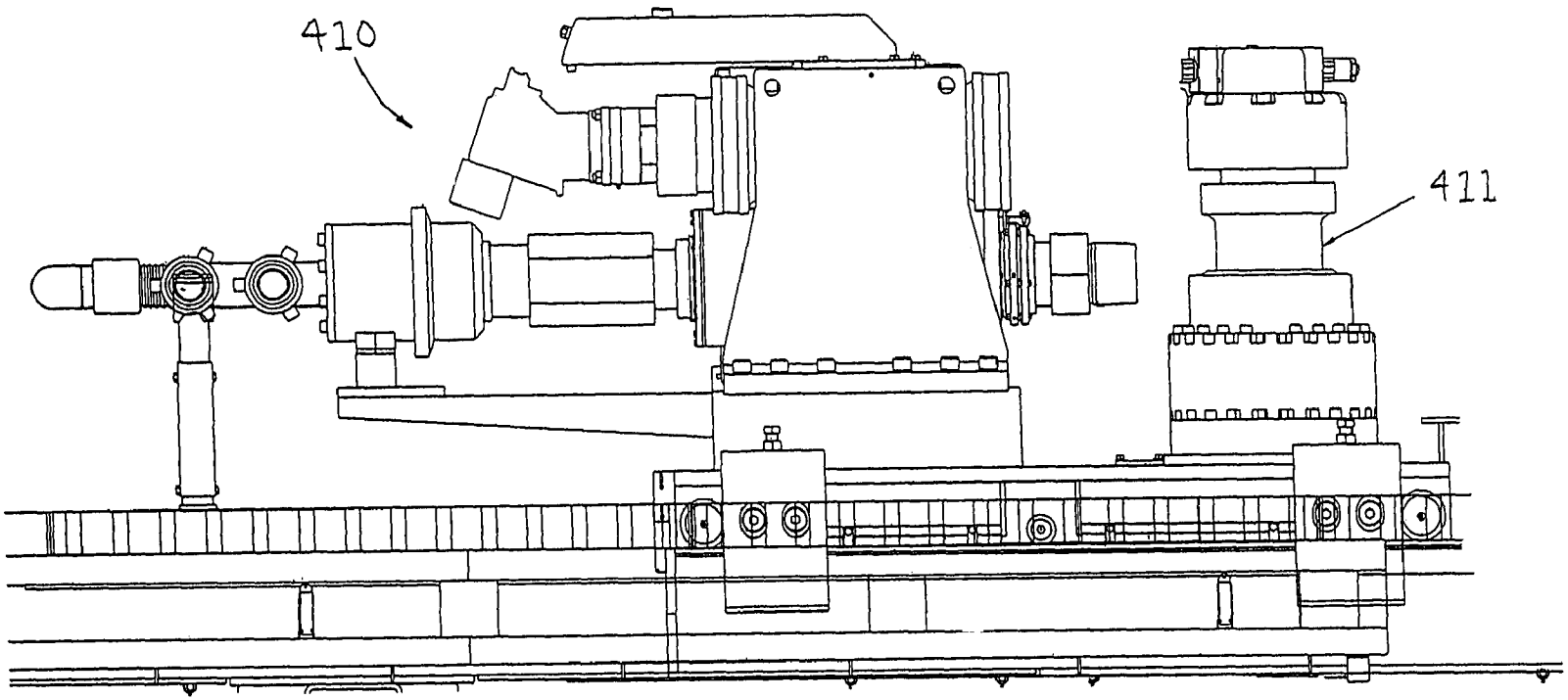
FIG. 18 is an exploded perspective view of the preferred rotary and carriage assembly of the drilling assembly illustrated in FIG. 17.

Still referring to FIG. 17, the preferred drilling assembly 400 also includes rotary and carriage assembly 410. See also FIG. 18. The preferred rotary and carriage assembly 410 is mounted on thrust frame 404 and is adapted to apply rotational, thrust and pull-back forces to a drill pipe. The preferred rotary and carriage assembly 410 includes carriage brake 411 adapted to discontinue movement of the rotary and carriage assembly along the thrust frame and hold the assembly in that position. The preferred carriage brake 411 is controlled by a microprocessor adapted to compare the direction of travel of rotary and carriage assembly 410 along thrust frame 404 to the position of a carriage joystick (not shown). The preferred joystick is adapted to control the direction of rotary and carriage assembly 410 along thrust frame 404.

Figure 19:
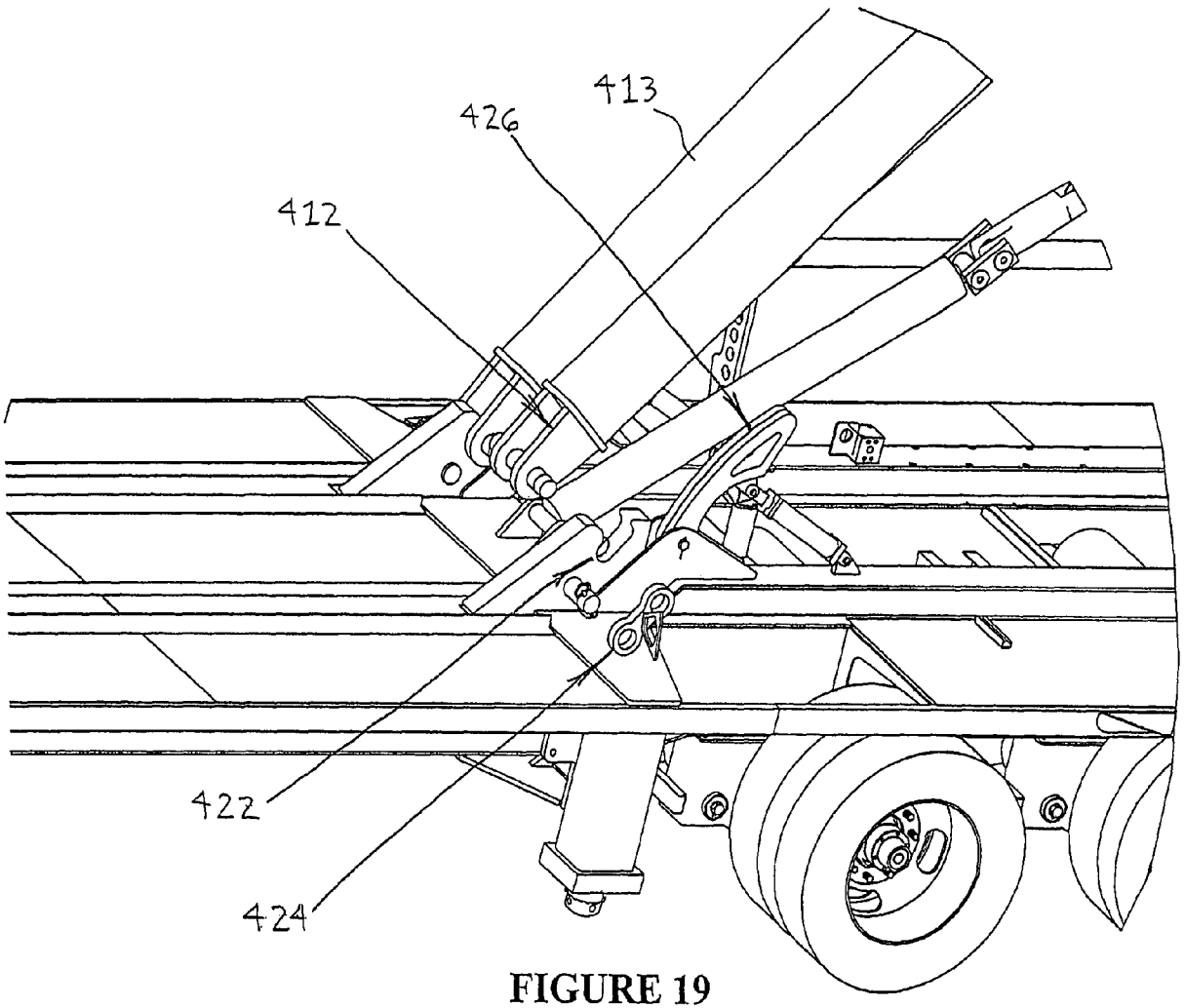
FIG. 19 is a perspective view of the preferred strut second end of the drilling assembly illustrated in FIG. 17.

Referring still to FIG. 17, the preferred drill assembly 400 further includes struts 412 and 413 having strut first ends 414 and 415, respectively, attached to the thrust frame and strut second ends 416 and 417, respectively, attached to trailer 420. The preferred strut first ends 414 and 415 are pivotally attached to the thrust frame and the preferred strut second ends 416 and 417 are slidingly attached to trailer 420. Preferably, each of the struts 412 and 413 extend from the thrust frame to the trailer, bear against the trailer between a pair of side plates and slide along the trailer's deck from the transport position (see FIG. 22) to the drilling position in tracks formed by the pair of side plates. In the preferred embodiments of the drilling assembly, the strut second ends slidingly bear against the trailer under the force of gravity, but it is contemplated within the scope of the invention that the strut second ends may be partially enclosed within the tracks formed by the side plates so as to prevent the strut second ends from losing contact with the trailer. In the drilling position, the strut second ends 416 and 417 self-engage large locking notches 422 to firmly lock the struts and prevent them from returning to the transport position. See also FIG. 19. Preferably, struts 412 and 413 are loaded in compression when the thrust frame is in the drilling position. In addition, links 424 are installed to prevent the thrust frame from continuing past the 90° (vertical) position. To lower thrust frame 404, links 424 are removed and struts 412 and 413 are ejected from notches 422 by hydraulically actuated levers 426. After ejection from notches 422, struts 412 and 413 slide automatically back to the transport position as the thrust frame 404 is lowered.

Referring still to FIG. 17, the preferred drilling assembly 400 also includes counteractive load assembly 430. The preferred counteractive load assembly 430 is adapted to apply a load in a direction toward trailer 420. As thrust frame 404 is raised, the weight of rotary and carriage assembly 410 causes the thrust frame to become overbalanced and an over-running load tends to cause the thrust frame to continue pivoting and go beyond the vertical position. A counteractive load from the preferred counteractive load assembly 430 is applied to maintain loading toward the trailer. The preferred counteractive load assembly 430 includes cable 432, swivel 434, and hydraulic cylinder 436. The preferred hydraulic cylinder 436 is attached to trailer 420. In the preferred embodiments of drill assembly 400, hydraulic cylinder 436 is pressurized to retract as telescoping cylinders 406 and 408 are pressured to extend. Thus, these forces oppose each other. Preferably, the force applied by retracting cable 432 exceeds the overrunning force due to gravity as thrust frame 404 approaches 80°, i.e. 10° from vertical. The preferred drilling assembly 400 also includes an anchoring system. The preferred anchoring system includes a tipping plate anchor, an anchor rod and an anchor hydraulic cylinder.

Figure 20:
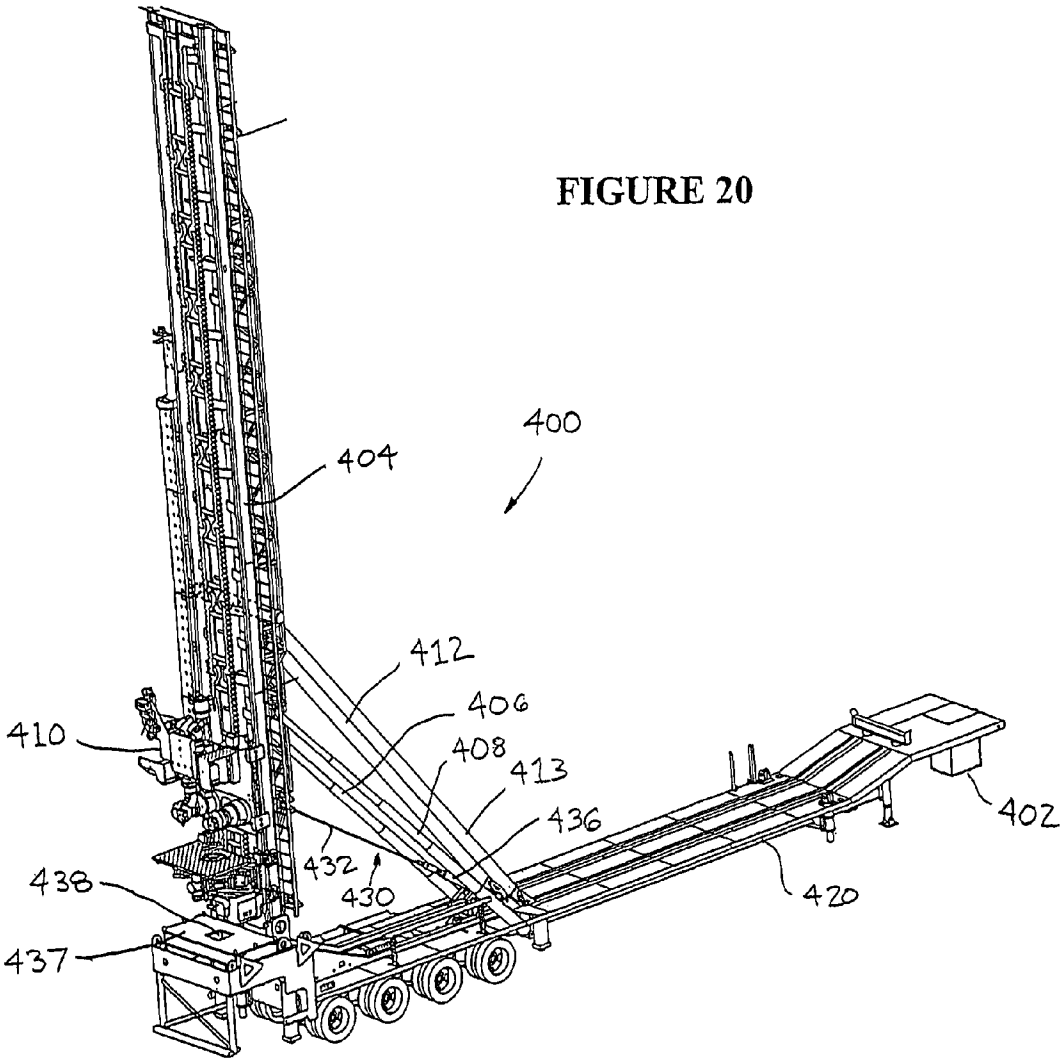
FIG. 20 is a perspective view of the preferred drilling assembly illustrated in FIG. 17.

Referring now to FIG. 20, a perspective view of preferred drilling assembly 400 is illustrated. As shown in FIG. 20, preferred drilling assembly 400 includes power unit 402, thrust frame 404, telescoping cylinders 406 and 408, rotary and carriage assembly 410, struts 412 and 413, trailer 420, counteractive load assembly 430, cable 432, and hydraulic cylinder 436. In addition, preferred drilling assembly 400 includes elevated drill floor 437 and opening 438.

Figure 21:
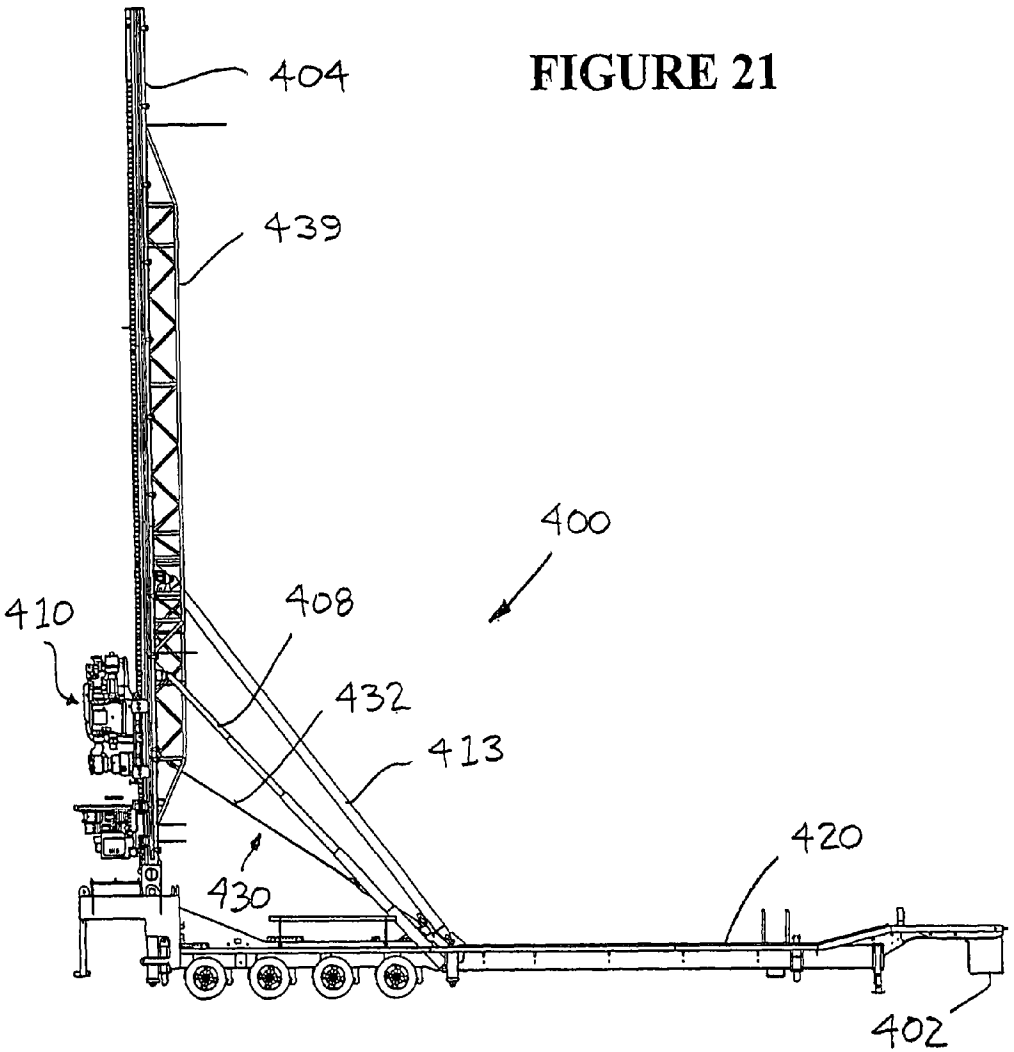
FIG. 21 is a front view of the preferred drilling assembly illustrated in FIG. 17.

Referring now to FIG. 21, a front view of the preferred drilling assembly 400 is illustrated. As shown in FIG. 21, preferred drilling assembly 400 includes power unit 402, thrust frame 404, telescoping cylinder 408, rotary and carriage assembly 410, strut 413, trailer 420, counteractive load assembly 430 and cable 432. In addition, preferred drilling assembly 400 includes lattice-type truss 439.

Figure 22:
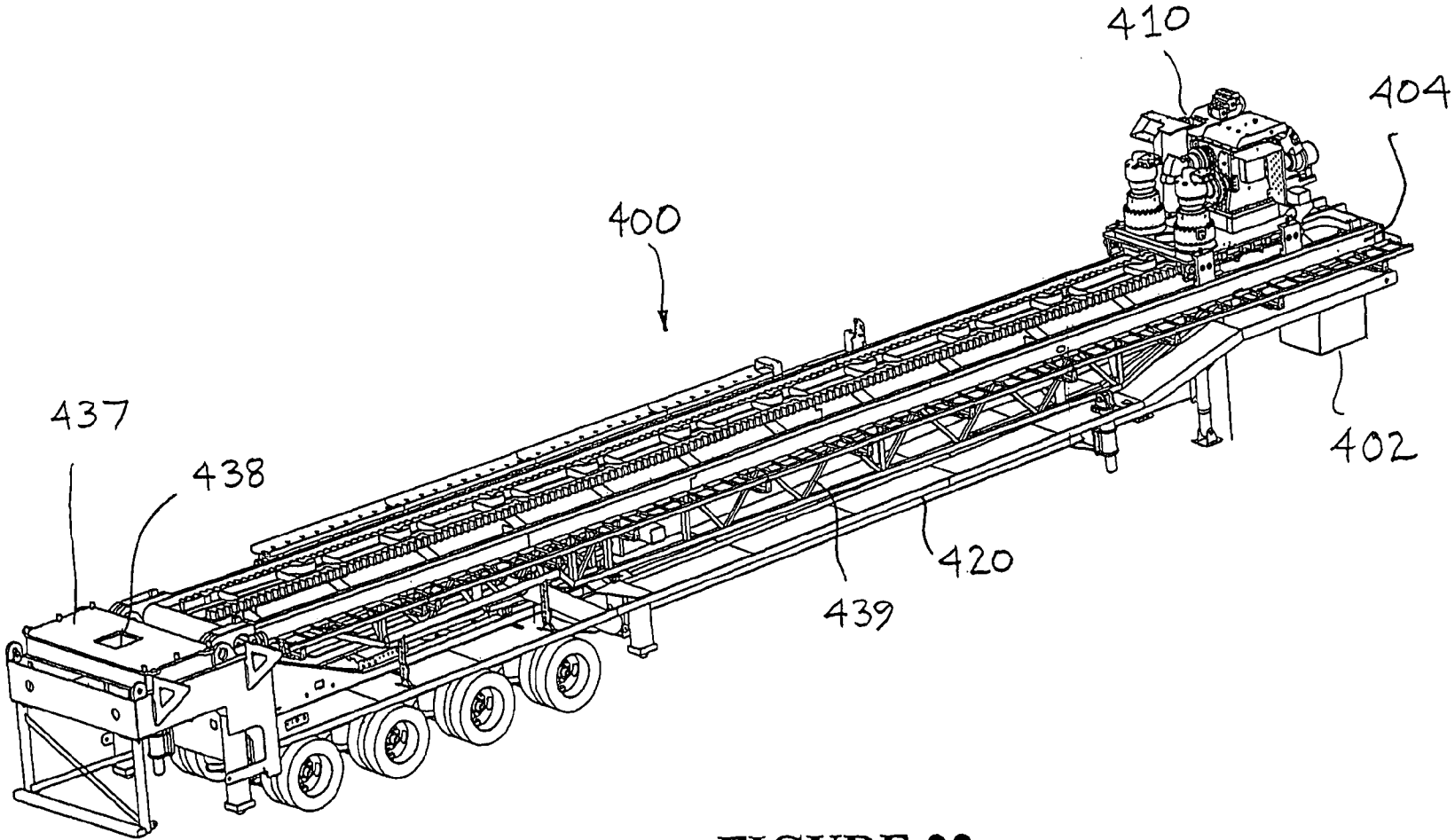
FIG. 22 is a perspective view of the preferred drilling assembly illustrated in FIG. 17 in the transport position.

Referring now to FIG. 22, a perspective view of the preferred drilling assembly 400 is illustrated in the transport position. As shown in FIG. 22, the preferred drilling assembly 400 includes power unit 402, thrust frame 404, telescoping cylinders 406 and 408, rotary and carriage assembly 410, trailer 420, elevated drill floor 437, opening 438 and lattice-type truss 439.

Figure 23:
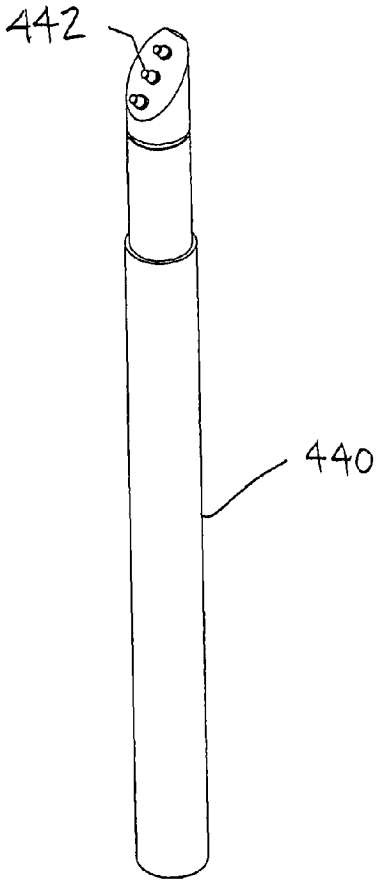
FIG. 23 is a front view of the preferred mud motor and the preferred drill bit used in connection with the drilling assembly illustrated in FIG. 17.

Referring now to FIG. 23, a front view of preferred mud motor 440 and drill bit 442 used in connection with drilling assembly 400 is illustrated. The preferred mud motor 440 is adapted to impart rotation to the drill bit 442 and carry cuttings away from the drill bit. It is contemplated within the scope of the invention that any suitable mud motor may be used with drilling assembly 400. While FIG. 23 illustrates a duck bill drill bit, it is contemplated within the scope of the invention that any suitable drill bit may be used with drilling assembly 400 including but not limited to a tri-cone drill bit.

Figure 23A:
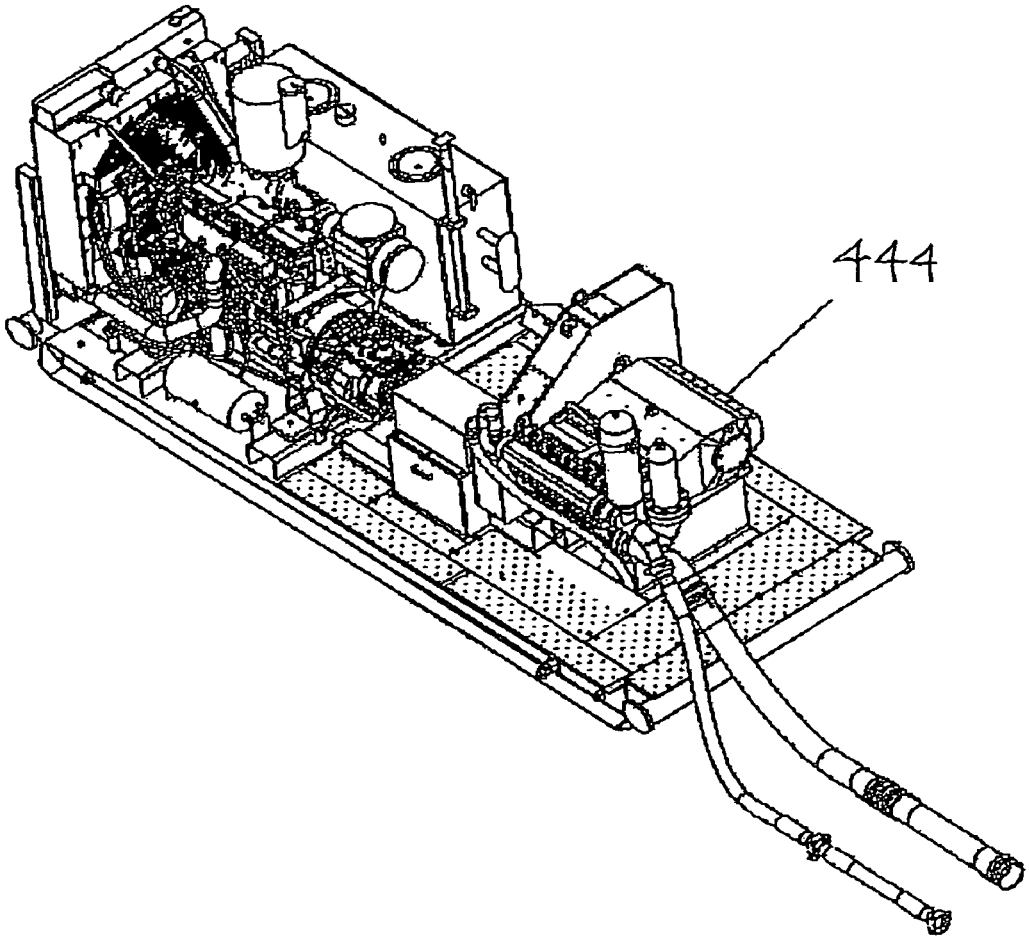
FIG. 23A is a perspective view of the preferred mud pump used in connection with the drilling assembly illustrated in FIG. 17.

Referring now to FIG. 23A, a perspective view of an exemplary mud pump is illustrated. The preferred mud pump is designated generally by reference numeral 444 and is adapted to transport mud under pressure to the drill bit. It is contemplated within the scope of the invention that any suitable mud pump adapted to transport mud under pressure to a drill bit may be used in connection with drilling assembly 400.

The preferred embodiments of the invention further include a method for drilling pipe into a drilling surface using a drill bit. The preferred method includes providing a drilling assembly such as preferred drilling assembly 400 described above. In addition, the preferred method includes placing a drill pipe onto the drilling assembly, moving the thrust frame to a desired drilling angle, moving the rotary and carriage assembly into contact with the drill pipe, applying rotational, thrust and pull-back forces to the drill pipe, drilling the pipe into the drilling surface and controlling the load on the drill bit based upon the level of mud pressure in the drilling assembly. The preferred embodiments of the method also include the steps of transporting mud under pressure to the drill bit, applying a load in a direction toward the trailer, discontinuing movement of the rotary and carriage assembly along the thrust frame, and anchoring the drilling assembly.

Figure 24:
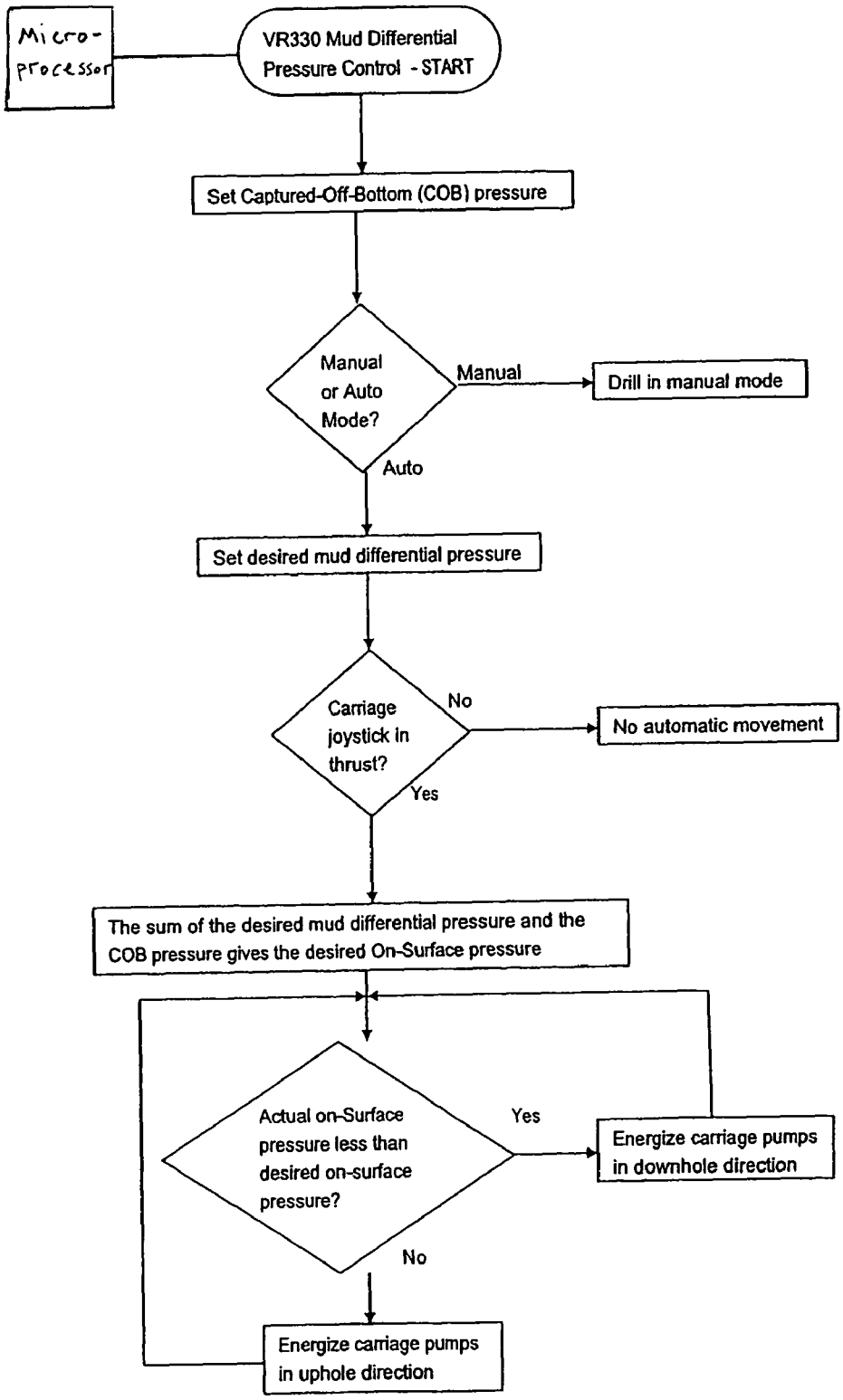
FIG. 24 is a flow chart illustrating the preferred method for controlling the load on the drill bit based upon the level of mud pressure in the drilling assembly.

Referring now to FIG. 24, a flow chart of the preferred method for controlling the load on the drill bit based upon the level of mud pressure in the drilling assembly is illustrated. In the preferred embodiments of the invention, the load on the drill bit is controlled by a microprocessor and a mud pump adapted to transport mud under pressure to the drill bit. However, it is contemplated within the scope of the invention that any suitable device, mechanism, assembly or combination thereof may be used to control the load on the drill bit. As shown in FIG. 24, initially the microprocessor determines a first mud pressure. In the preferred embodiments of the invention, the first mud pressure is the measure of pressure in the assembly when the drill bit is disengaged from the drilling surface or the "captured-off-bottom" ("COB") pressure. The COB pressure is recorded by the microprocessor, and the operator may choose to record a new and different COB pressure as drilling operations progress. Next, the determination is made whether the system is in manual or automatic mode. If the system is in manual mode, the drilling assembly proceeds with drilling operations in manual mode. If, however, the system is in automatic mode, a desired mud differential pressure is set by the operator.

Still referring to FIG. 24, the system next determines whether the carriage joystick is in the thrust position. If the joystick is not in the thrust position, then there is no automatic movement in the carriage. If, on the other hand, the carriage joystick is in the thrust position, the system calculates the sum of the desired mud differential pressure and the COB pressure to produce a desired load on drill bit. The microprocessor then determines a second mud pressure. In the preferred embodiments of the invention, the second mud pressure is the measure of pressure in the assembly when the drill bit is engaged with the drilling surface or the "actual load on drill bit". The system then compares the sum of the COB pressure and the differential pressure (the "desired load on drill bit") to the actual load on drill bit. If the actual load on drill bit is less than the sum of the COB pressure and the differential pressure (the desired load on drill bit), then the system causes the carriage to move in a downhole direction. If, however, the actual load on drill bit is not less then the sum of the COB pressure and the differential pressure (the desired load on drill bit), then the system causes the carriage to move in an uphole direction. In the preferred embodiments of the invention, the COB pressure, the desired mud differential pressure, the desired load on drill bit and the actual load on drill bit are displayed to the operator by any suitable means during drilling operations.

Figure 25A:
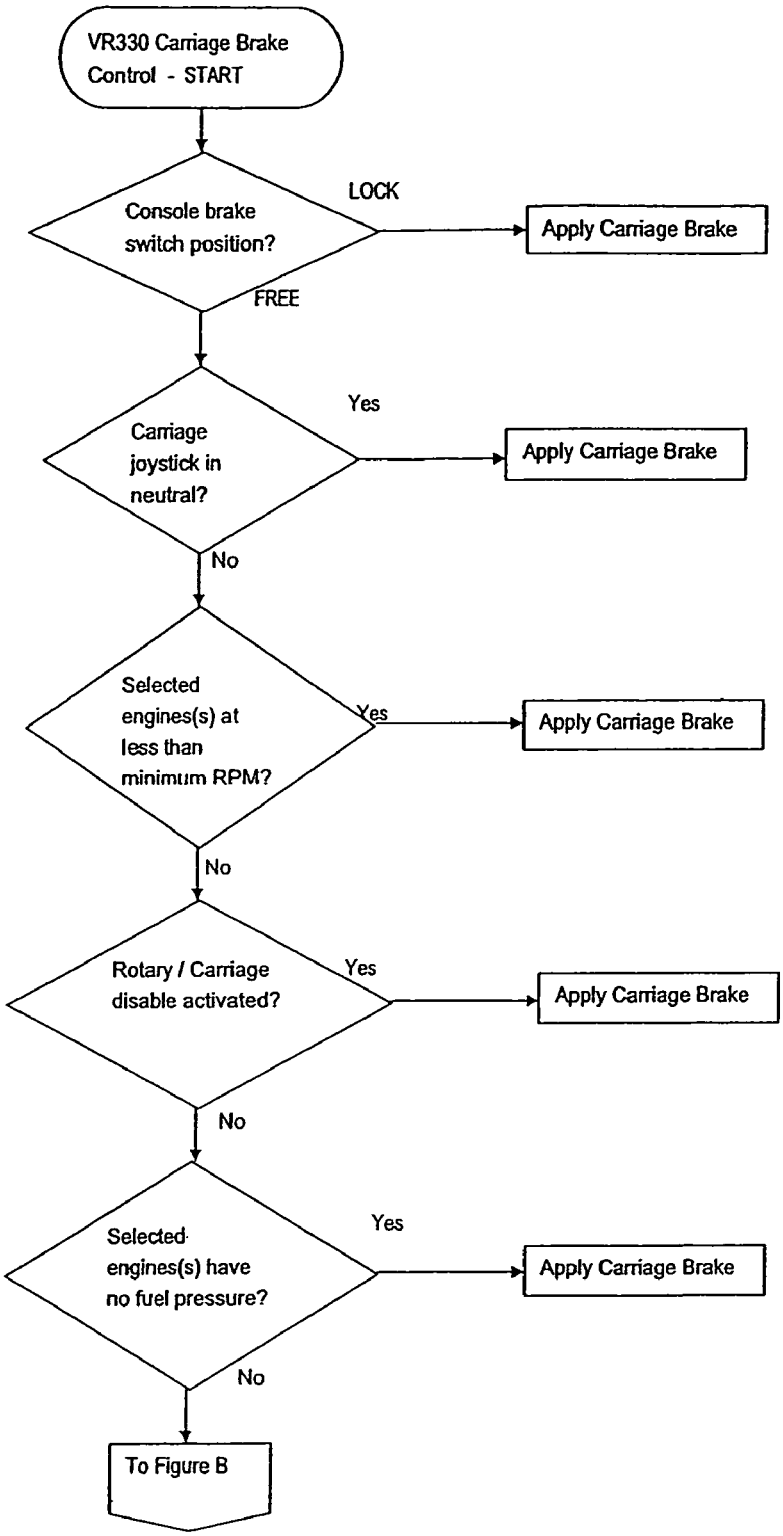
FIGS. 25A-C are a flow chart illustrating the preferred method for controlling the carriage brake.
Figure 25B:
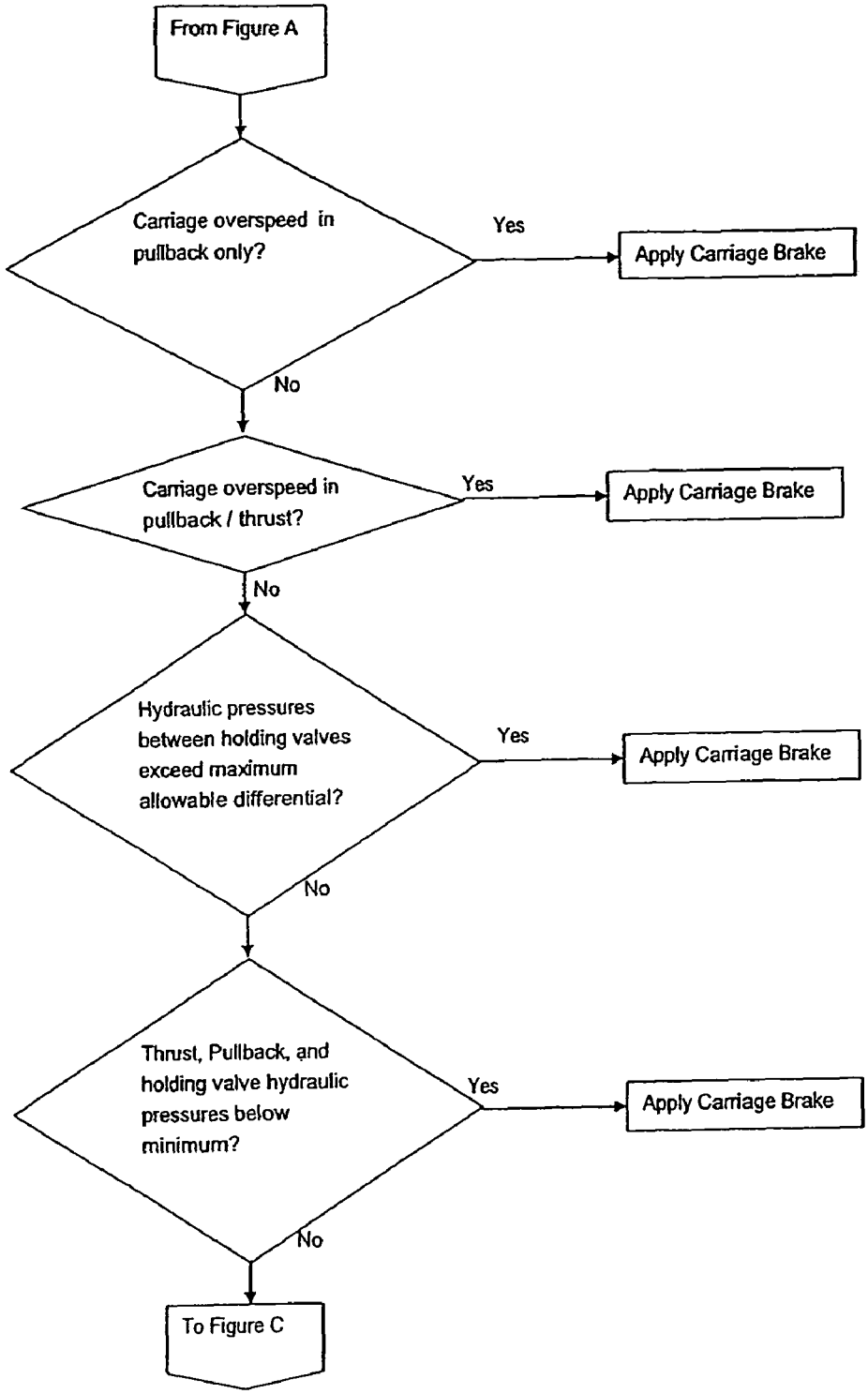
Figure 25C:
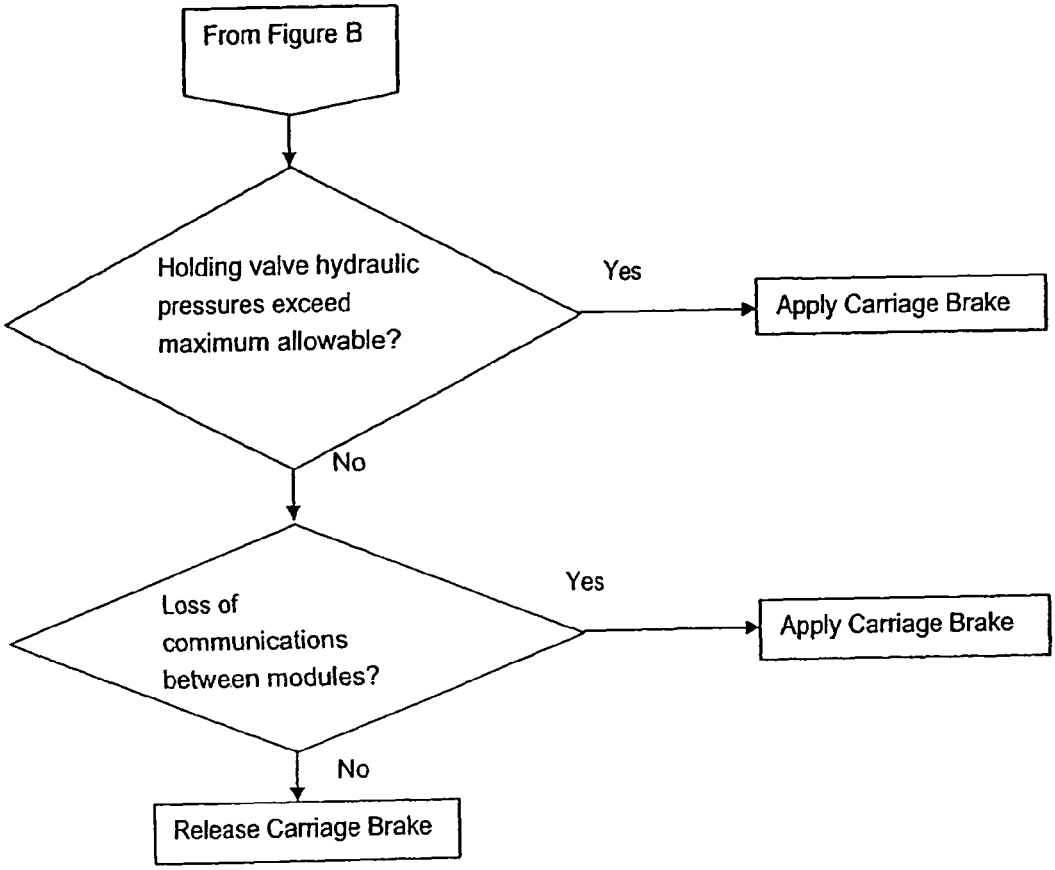

Referring now to FIGS. 25A-C, a flow chart of the preferred method for controlling the carriage brake in accordance with the present invention is illustrated. The preferred carriage brake of the invention is adapted to discontinue movement of the rotary and carriage assembly along the thrust frame. The preferred carriage brake is controlled by a microprocessor adapted to compare the direction of travel of the rotary and carriage assembly along the thrust frame to the position of a carriage joystick. In the preferred embodiments of the invention, the carriage joystick is adapted to control the direction of the rotary and carriage assembly along the thrust frame.

Referring now to FIG. 25A, if the console brake switch is in the "LOCK" position, the carriage brake will be applied. If, however, the console brake switch is in the "FREE" position, then the position of the carriage joystick is determined. If the carriage joystick is in the "neutral" position, then the carriage brake is applied. If, however, the carriage joystick is not in the "neutral" position, then the revolutions per minute ("RPM's") of selected engine(s) is determined. If the RPM's of the selected engine(s) is less than a predetermined minimum RPM, then the carriage brake is applied. If, however, the RPM's of the selected engine(s) is not less than a predetermined minimum RPM, then status of the rotary/carriage disable is determined. If the rotary/carriage disable is activated, then the carriage brake is applied. If, however, the rotary/carriage disable is not activated, then the status of the fuel pressure in selected engine(s) is determined. If there is no fuel pressure in the selected engine(s), then the carriage brake is applied. If, however, there is fuel pressure in the selected engines(s), then the speed of the rotary and carriage assembly is compared to a preset speed limit.

Referring now to FIG. 25B, if the rotary and carriage assembly exceeds the preset speed limit and the carriage joystick is deflected in the pullback position only, then the carriage brake is applied. If, however, the rotary and carriage assembly exceeds the preset speed limit and the carriage joystick is not deflected in the pullback position only, then the status of the rotary and carriage assembly is again determined. If the rotary and carriage assembly exceeds the preset speed limit and the carriage joystick is deflected in the pullback or thrust position, then the carriage brake is applied. If, however, the rotary and carriage assembly exceeds the preset speed limit and the carriage joystick is not deflected in the pullback or thrust position, then the hydraulic pressures between holding valves is determined. If the hydraulic pressures between holding valves exceed a predetermined maximum allowable differential, then the carriage brake is applied. If, however, the hydraulic pressures between holding valves do not exceed the predetermined maximum allowable differential, then the thrust, pullback and holding valve hydraulic pressures are determined. If the thrust, pullback and holding valve hydraulic pressures are below a predetermined minimum hydraulic pressure, then the carriage brake is applied. If, however, the thrust, pullback and holding valve hydraulic pressures are not below the predetermined minimum hydraulic pressure, then the holding valve hydraulic pressure is determined.

Referring now to FIG. 25C, if the holding valve hydraulic pressure exceeds a predetermined maximum allowable pressure, then the carriage brake is applied. If, however, the holding valve hydraulic pressure does not exceed the predetermined maximum allowable pressure, then the status of communications between modules is determined. If there is a loss of communications between modules, then the carriage brake is applied. If, however, there is not a loss of communications between modules, then the carriage brake is released.

In operation, preferred drilling assembly 400 achieves several advantages. For example, the preferred drilling assembly 400 is adapted to automatically control the load on the drill bit based upon the level of mud pressure in the drilling assembly. The preferred drill assembly 400 is also adapted to automatically discontinue movement of the rotary and carriage assembly along the thrust frame. The preferred drilling assembly 400 further permits hands-off drilling operations similar in effect to the cruise control on a motorized vehicle. More particularly, the preferred drilling assembly 400 automatically drills drill pipe at a desired rate, within a relatively small range of tolerance, without the operator having to make frequent adjustments.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalence of the appended claims.

What is claimed is:

1. A drilling assembly for drilling pipe into a drilling surface using a drill bit, said drilling assembly comprising:

(a) a power unit for supplying power to the drilling assembly;

(b) a thrust frame adapted to be moved between a position substantially parallel to the drilling surface and a position substantially perpendicular to the drilling surface;

(c) a means for moving the thrust frame;

(d) a rotary and carriage assembly mounted on the thrust frame, said rotary and carriage assembly being adapted to apply rotational, thrust and pull-back forces to the drill pipe;

(e) a microprocessor, said microprocessor being adapted to regulate an advance rate of and control a load on the drill bit based upon a level of mud pressure in a mud circuit in the drilling assembly and in response to a mechanical resistance experienced by the drill bit;

wherein the drilling assembly is adapted to drill pipe into the drilling surface at any angle relative to the drilling surface between substantially parallel to the drilling surface and substantially perpendicular to the drilling surface.

2. The drilling assembly of claim 1 further comprising a mud pump, said mud pump being adapted to transport mud under pressure to the drill bit.

3. The drilling assembly of claim 1 further comprising a mud motor, said mud motor being adapted to impart rotation to the drill bit and carry cuttings away from the drill bit.

4. The drilling assembly of claim 1 wherein the microprocessor is adapted to determine a first mud pressure, said first mud pressure being the measure of pressure in the assembly when the drill bit is disengaged from the drilling surface.

5. The drilling assembly of claim 4 wherein the microprocessor is adapted to determine a second mud pressure, said second mud pressure being the measure of pressure in the assembly when the drill bit is engaged with the drilling surface.

6. The drilling assembly of claim 5 wherein the microprocessor is adapted to compare the second mud pressure to the sum of the first mud pressure and a desired mud differential pressure.

7. The drilling assembly of claim 1 further comprising a strut, said strut having a strut first end attached to the thrust frame and a strut second end attached to a trailer.

8. The drilling assembly of claim 7 wherein the strut first end is pivotally attached to the thrust frame and the strut second end is slidingly attached to the trailer.

9. The drilling assembly of claim 1 further comprising a counteractive load assembly, said counteractive load assembly being adapted to apply a load in a direction toward a trailer.

10. The drilling assembly of claim 1 further comprising a carriage brake, said carriage brake being adapted to discontinue movement of the rotary and carriage assembly along the thrust frame.

11. The drilling assembly of claim 10 wherein the carriage brake is controlled by the microprocessor, said microprocessor being adapted to compare the direction of travel of the rotary and carriage assembly along the thrust frame to the position of a joystick, said joystick being adapted to control the direction of the rotary and carriage assembly along the thrust frame.

12. The drilling assembly of claim 1 further comprising an anchoring system.

13. The drilling assembly of claim 12 wherein the anchoring system comprises a tipping plate anchor, an anchor rod and an anchor hydraulic cylinder.

14. A drilling assembly for drilling pipe into a drilling surface using a drill bit, said drilling assembly comprising:

(a) a power unit for supplying power to the drilling assembly;

(b) a thrust frame adapted to be moved between a position substantially parallel to the drilling surface and a position substantially perpendicular to the drilling surface;

(c) a means for moving the thrust frame;

(d) a rotary and carriage assembly mounted on the thrust frame, said rotary and carriage assembly being adapted to apply rotational, thrust and pull-back forces to the drill pipe;

(e) a microprocessor, said microprocessor being adapted to regulate an advance rate of and control a load on the drill bit based upon a level of mud pressure in a mud circuit in the drilling assembly and in response to a mechanical resistance experienced by the drill bit;

wherein the microprocessor is adapted to determine a first mud pressure, said first mud pressure being the measure of pressure in the assembly when the drill bit is disengaged from the drilling surface; and wherein the microprocessor is adapted to determine a second mud pressure, said second mud pressure being the measure of pressure in the assembly when the drill bit is engaged with the drilling surface; and wherein the microprocessor is adapted to compare the second mud pressure to the sum of the first mud pressure and a desired mud differential pressure; and wherein the drilling assembly is adapted to drill pipe into the drilling surface at any angle relative to the drilling surface between substantially parallel to the drilling surface and substantially perpendicular to the drilling surface.

15. A drilling assembly for drilling pipe into a drilling surface using a drill bit, said drilling assembly comprising:

(a) a power unit for supplying power to the drilling assembly;

(b) a thrust frame adapted to be moved between a position substantially parallel to the drilling surface and a position substantially perpendicular to the drilling surface;

(c) a means for moving the thrust frame;

(d) a rotary and carriage assembly mounted on the thrust frame, said rotary and carriage assembly being adapted to apply rotational, thrust and pull-back forces to the drill pipe;

(e) a microprocessor, said microprocessor being adapted to regulate an advance rate of and control a load on the drill bit based upon a level of mud pressure in a mud circuit in the drilling assembly and in response to a mechanical resistance experienced by the drill bit;

(f) a counteractive load assembly, said counteractive load assembly being adapted to apply a load in a direction toward the trailer;

wherein the drilling assembly is adapted to drill pipe into the drilling surface at any angle relative to the drilling surface between substantially parallel to the drilling surface and substantially perpendicular to the drilling surface.

16. A drilling assembly for drilling pipe into a drilling surface using a drill bit, said drilling assembly comprising:

(a) a power unit for supplying power to the drilling assembly;

(b) a thrust frame adapted to be moved between a position substantially parallel to the drilling surface and a position substantially perpendicular to the drilling surface;

(c) a means for moving the thrust frame;

(d) a rotary and carriage assembly mounted on the thrust frame, said rotary and carriage assembly being adapted to apply rotational, thrust and pull-back forces to the drill pipe;

(e) a microprocessor, said microprocessor being adapted to regulate an advance rate of and control a load on the drill bit based upon a level of mud pressure in a mud circuit in the drilling assembly and in response to a mechanical resistance experienced by the drill bit;

(f) a carriage brake, said carriage brake being adapted to discontinue movement of the rotary and carriage assembly along the thrust frame;

wherein the drilling assembly is adapted to drill pipe into the drilling surface at any angle relative to the drilling surface between substantially parallel to the drilling surface and substantially perpendicular to the drilling surface.

17. A method for drilling pipe into a drilling surface using a drill bit; said method comprising:

(a) providing a drilling assembly, said drilling assembly comprising:

(1) a power unit for supplying power to the drilling assembly;

(2) a thrust frame adapted to be moved between a position substantially parallel to the drilling surface and a position substantially perpendicular to the drilling surface;

(3) a means for moving the thrust frame;

(4) a rotary and carriage assembly mounted on the thrust frame, said rotary and carriage assembly being adapted to apply rotational, thrust and pull-back forces to the drill pipe;

(5) a microprocessor, said microprocessor being adapted to regulate an advance rate of and control a load on the drill bit based upon a level of mud pressure in a mud circuit in the drilling assembly and in response to a mechanical resistance experienced by the drill bit;

wherein the drilling assembly is adapted to drill pipe into the drilling surface at any angle relative to the drilling surface between substantially parallel to the drilling surface and substantially perpendicular to the drilling surface;

(b) placing a drill pipe onto the drilling assembly;

(c) moving the thrust frame to a desired drilling angle;

(d) moving the rotary and carriage assembly into contact with the drill pipe;

(e) applying rotational, thrust and pull-back forces to the drill pipe;

(f) drilling the pipe into the drilling surface; and (g) controlling the load on the drill bit based upon the level of mud pressure in the drilling assembly.

18. The method of claim 17 further comprising transporting mud to the drill bit.

19. The method of claim 17 further comprising applying a load in a direction toward a trailer.

20. The method of claim 17 further comprising discontinuing movement of the rotary and carriage assembly along the thrust frame.

21. The method of claim 17 further comprising anchoring the drilling assembly.

* * * * *